US007528687B2

(12) United States Patent
Inoue et al.

(10) Patent No.: US 7,528,687 B2
(45) Date of Patent: May 5, 2009

(54) FILTERING DEVICE AND CIRCUIT MODULE

(75) Inventors: Hiroto Inoue, Shinagawa (JP); Shigemi Kurashima, Shinagawa (JP); Takuya Uchiyama, Shinagawa (JP); Masahiro Yanagi, Shinagawa (JP); Takashi Arita, Shinagawa (JP); Kiyomichi Araki, Meguro (JP); Hitoshi Ishida, Meguro (JP)

(73) Assignees: Fujitsu Component Limited, Tokyo (JP); Tokyo Institute of Technology, Tokyo (JP)

( * ) Notice: Subject to any disclaimer, the term of this patent is extended or adjusted under 35 U.S.C. 154(b) by 382 days.

(21) Appl. No.: 11/106,639

(22) Filed: Apr. 15, 2005

(65) Prior Publication Data

US 2005/0242905 A1 Nov. 3, 2005

(30) Foreign Application Priority Data

Apr. 30, 2004 (JP) ..... 2004-136268

(51) Int. Cl.
*H01P 3/08* (2006.01)

(52) U.S. Cl. ..... 333/204; 333/205; 333/185

(58) Field of Classification Search ..... 333/204, 333/205, 185, 167
See application file for complete search history.

(56) References Cited

U.S. PATENT DOCUMENTS 3,417,352 A * 12/1968 Waller ..... 333/204
4,412,272 A * 10/1983 Wedertz et al. ..... 361/692
5,584,064 A 12/1996 Nakamura
5,699,025 A * 12/1997 Kanoh et al. ..... 333/177
5,747,874 A 5/1998 Seki
6,022,759 A 2/2000 Seki
6,130,651 A 10/2000 Yanagisawa
6,157,274 A * 12/2000 Tada et al. ..... 333/204
6,456,172 B1 * 9/2002 Ishizaki et al. ..... 333/133
6,720,849 B2 4/2004 Sasaki

FOREIGN PATENT DOCUMENTS

JP 03-216002 9/1991
JP 7-183732 7/1995
JP 07-254811 10/1995
JP 8-148629 6/1996

(Continued)

OTHER PUBLICATIONS

Hitoshi Ishida et al., "Design and Analysis of Band Pass Filter with Ring Resonator", Technical Report of IEICE, WBS2003-20, MW2003-32 (May 2003).

(Continued)

*Primary Examiner*—Robert J. Pascal
*Assistant Examiner*—Kimberly E Glenn
(74) *Attorney, Agent, or Firm*—Staas & Halsey LLP

(57) ABSTRACT

A filtering device is disclosed that can be made compact and has wide-band band-pass characteristics. The filtering device includes a first filtering unit that is composed of a distributed constant circuit and is capable of eliminating a first frequency component or a second frequency component wherein the second frequency being higher than the first frequency, and a second filtering unit that attenuates components of frequencies lower than the first frequency or components of frequencies higher than the second frequency.

30 Claims, 28 Drawing Sheets

FOREIGN PATENT DOCUMENTS

| | | |
|---|---|---|
| JP | 09-139612 | 5/1997 |
| JP | 11-17405 | 1/1999 |
| JP | 11-317612 | 11/1999 |
| JP | 2002-151908 | 5/2002 |
| JP | 2002-368518 | 12/2002 |
| JP | 2004-023334 | 1/2004 |

OTHER PUBLICATIONS

Office Action in corresponding Japanese Patent Application No. 2004-136268, mailed Oct. 23, 2007 (3 pages).

* cited by examiner

FILTERING DEVICE AND CIRCUIT MODULE

BACKGROUND OF THE INVENTION

1. Field of the Invention

The present invention generally relates to a filtering device and a circuit module, and particularly, to a filtering device and a circuit module using a distributed constant circuit.

2. Description of the Related Art

The UWB (Ultra-Wide-Band) communication scheme is attracting attention in short-distance radio communications. Generally, UWB communication indicates communications which utilizes a frequency band higher than 500 MHz or a frequency band having a band ratio higher than 20%, carries out digital modulation and direct spreading to a high frequency band, and thereby allows utilization of a frequency band as wide as a few GHz and radio communications at speed as high as a few Mbps.

In UWB communications, in order that existing electromagnetic signals are not interfered with during wide-band communications, a wide-band and sharp band-pass filter is required.

The existing dielectric filters, or SAW (surface acoustic wave) filters, however, only have band ratios lower than 8%, and it is thought that further expansion of the band ratios is difficult.

To solve this problem, development is made of a ring filter using a distributed constant circuit in order to obtain wide-band frequency characteristics. For example, Japanese Laid-Open Patent Application No. 7-183732 and Japanese Laid-Open Patent Application No. 11-17405 disclose techniques in this field.

Because the ring filter is a distributed constant circuit, is can be constructed in a plane, and is able to obtain wide pass-band, low-pass loss, and a sharp attenuation pole. For these reasons, attention is being paid to application of the ring filter to UWB communications.

FIG. 1 is a view illustrating a structure of the ring filter.

As illustrated in FIG. 1, a ring filter 1 includes a ring portion 11 and an open stub 12. The ring portion 11 includes a λ/2 path portion 11*a*, a first λ/4 path portion 11*b*, and a second λ/4 path portion 11*c*. Here, λ represents the wavelength corresponding to a central frequency.

One end of the λ/2 path portion 11*a* is connected to a port P1, and the other end of the λ/2 path portion 11*a* is connected to a port P2.

One end of the first λ/4 path portion 11*b* is connected to the port P1, and the other end of the first λ/4 path portion 11*b* is connected to one end of the second λ/4 path portion 11*c*.

One end of the second λ/4 path portion 11*c* is connected to the first λ/4 path portion 11*b*, and the other end of the second λ/4 path portion 11*c* is connected to the port P2.

One end of the open stub 12 is connected to the connecting point of the first λ/4 path portion 11*b* and the second λ/4 path portion 11*c*, and the other end of the open stub 12 is open.

FIG. 2 shows pass-band characteristics of the ring filter.

Using the ring filter 1 illustrated in FIG. 1, it is possible to obtain band-elimination characteristics as shown in FIG. 2, namely, two attenuation pole frequencies f1, f2 are symmetrically located on two sides of the central frequency, which is defined to be the frequency f0 corresponding to the wavelength λ.

However, the ring filter 1 showing the band-elimination characteristics as shown in FIG. 2 cannot be used as a band-pass filter directly, because the frequency attenuation poles are too sharp.

Upon that, it is proposed to expand the low-frequency attenuation poles and the high-frequency attenuation poles of plural ring filters, and connect these ring filters in cascade so as to expand the bands of the low-frequency attenuation pole and the high-frequency attenuation pole, and obtain frequency characteristics close to that of a band-pass filter. For example, this technique is described by Ishida et al., in "Development of wide-band ring filter", Technical Report of IEICE, WBS2003-20, MW2003-32 (2003-05).

FIG. 3 is a view of a filtering device using the ring filters.

FIG. 4 shows the band characteristics of the filtering device using the ring filters.

As illustrated in FIG. 3, a filtering device 20 includes a first ring filter 21, a second ring filter 22, and a third ring filter 23.

The first ring filter 21, the second ring filter 22, and the third ring filter 23 have the same structure as shown in FIG. 1. One end of the first ring filter 21 is connected to the port P1, and the other end of the first ring filter 21 is connected to the second ring filter 22. One end of the second ring filter 22 is connected to the first ring filter 21, and the other end of the second ring filter 22 is connected to the third ring filter 23. One end of the third ring filter 23 is connected to the second ring filter 22, and the other end of the third ring filter 23 is connected to the port P2.

The first ring filter 21 includes an open stub 21*a*, a λ/2 path portion 21*b*, λ/4 path portion 21*c*, and λ/4 path portion 21*d*, and widths and lengths of the open stub 21*a*, the λ/2 path portion 21*b*, the λ/4 path portion 21*c*, and the λ/4 path portion 21*d* are specified such that the first ring filter 21 shows frequency characteristics having two attenuation pole frequencies f11 and f12, as shown by the dashed line in FIG. 4. With given widths and lengths of the open stub 21*a*, the λ/2 path portion 21*b*, the λ/4 path portion 21*c*, and the λ/4 path portion 21*d*, the impedances of the open stub 21*a*, the λ/2 path portion 21*b*, and the λ/4 path portions 21*c*, 21*d* are uniquely determined, and are denoted as Z11, Z12, and Z13, respectively.

The second ring filter 22 includes an open stub 22*a*, a λ/2 path portion 22*b*, and λ/4 path portions 22*c*, 22*d*, and widths and lengths of the open stub 22*a*, the λ/2 path portion 22*b*, and the λ/4 path portions 22*c*, 22*d* are specified such that the second ring filter 22 shows frequency characteristics having two attenuation pole frequencies f21 and f22, as shown by the dot-dashed line in FIG. 4. The corresponding impedances of the open stub 22*a*, the λ/2 path portion 22*b*, and the λ/4 path portions 22*c*, 22*d* are determined to be Z21, Z22, and Z23.

Similarly, the third ring filter 23 includes an open stub 23*a*, a λ/2 path portion 23*b*, and λ/4 path portions 23*c*, 23*d*, and widths and lengths of the open stub 23*a*, the λ/2 path portion 23*b*, and the λ/4 path portions 23*c*, 23*d* are specified such that the third ring filter 23 shows frequency characteristics having two attenuation pole frequencies f31 and f32, as shown by the double dot-dashed line in FIG. 4. The corresponding impedances of the open stub 23*a*, the λ/2 path portion 23*b*, and the λ/4 path portions 23*c*, 23*d* are determined to be Z31, Z32, and Z33.

The frequency characteristics of the filtering device 20 correspond to a combination of the frequency characteristics of the first ring filter 21, the second ring filter 22, and the third ring filter 23, and are shown by the solid line in FIG. 4. As shown in FIG. 4, by connecting the first ring filter 21, the second ring filter 22, and the third ring filter 23 in cascade, which have different low-frequency attenuation poles and high-frequency attenuation poles, the bands of the low-frequency attenuation pole and the high-frequency attenuation pole of the filtering device 20 are expanded, as shown by the solid line in FIG. 4, resulting in frequency characteristics close to those of a band-pass filter.

In the above descriptions, for simplicity, it is assumed that three ring filters are connected in cascade, however, in practical UWB communications, three-stages of ring filters are not sufficient, and a larger number of stages of ring filters is needed. However, when connecting more ring filters in cascade, the size of the filtering device increases, and pass loss in the filtering device increases.

SUMMARY OF THE INVENTION

It is a general object of the present invention to solve one or more of the problems of the related art.

It is a more specific object of the present invention to provide a filtering device that can be made compact and has wide-band band-pass characteristics, and a circuit module.

According to a first aspect of the present invention, there is provided a filtering device for passing predetermined frequency components of an input signal, comprising a first filtering unit including a distributed constant circuit and capable of eliminating a first frequency component or a second frequency component, said second frequency being higher than said first frequency; and a second filtering unit that attenuates components of frequencies lower than the first frequency or components of frequencies higher than the second frequency.

According to the present invention, the first filtering unit including a distributed constant circuit produces wide-band band-pass characteristics, and the second filtering unit attenuates the low attenuation pole frequency component and the high attenuation pole frequency component. As a result, band-pass characteristics are obtainable.

In addition, the first filtering unit including a distributed constant circuit produces wide-band band-pass characteristics, and the second filtering unit attenuates the low attenuation pole frequency component and the high attenuation pole frequency component, thereby, producing wide-band band-pass characteristics. As a result, the first filtering unit having band-elimination characteristics can be used directly; hence, the first filtering unit can be made compact. Therefore, it is possible to provide a filtering device that can be made compact and has wide-band band-pass characteristics.

According to a second aspect of the present invention, there is provided a circuit module, comprising: a circuit board; a filtering unit formed from conductive patterns on the circuit board functioning as a distributed constant circuit; and chip parts arranged on the circuit board and constituting peripheral circuits of the filtering unit.

Alternatively, the circuit module comprises a distributed constant circuit having a plurality of stubs, wherein corners of the stubs in proximity of other stubs are rounded.

Alternatively, the circuit module includes a flexible printed circuit board on which a distributed constant circuit is arranged, wherein the flexible printed circuit board is sealed by using a dielectric resin with the flexible printed circuit board being folded or rolled.

These and other objects, features, and advantages of the present invention will become more apparent from the following detailed description of the preferred embodiments given with reference to the accompanying drawings.

DESCRIPTION OF THE PREFERRED EMBODIMENTS

Below, preferred embodiments of the present invention are explained with reference to the accompanying drawings.

First Embodiment

Figure 5:
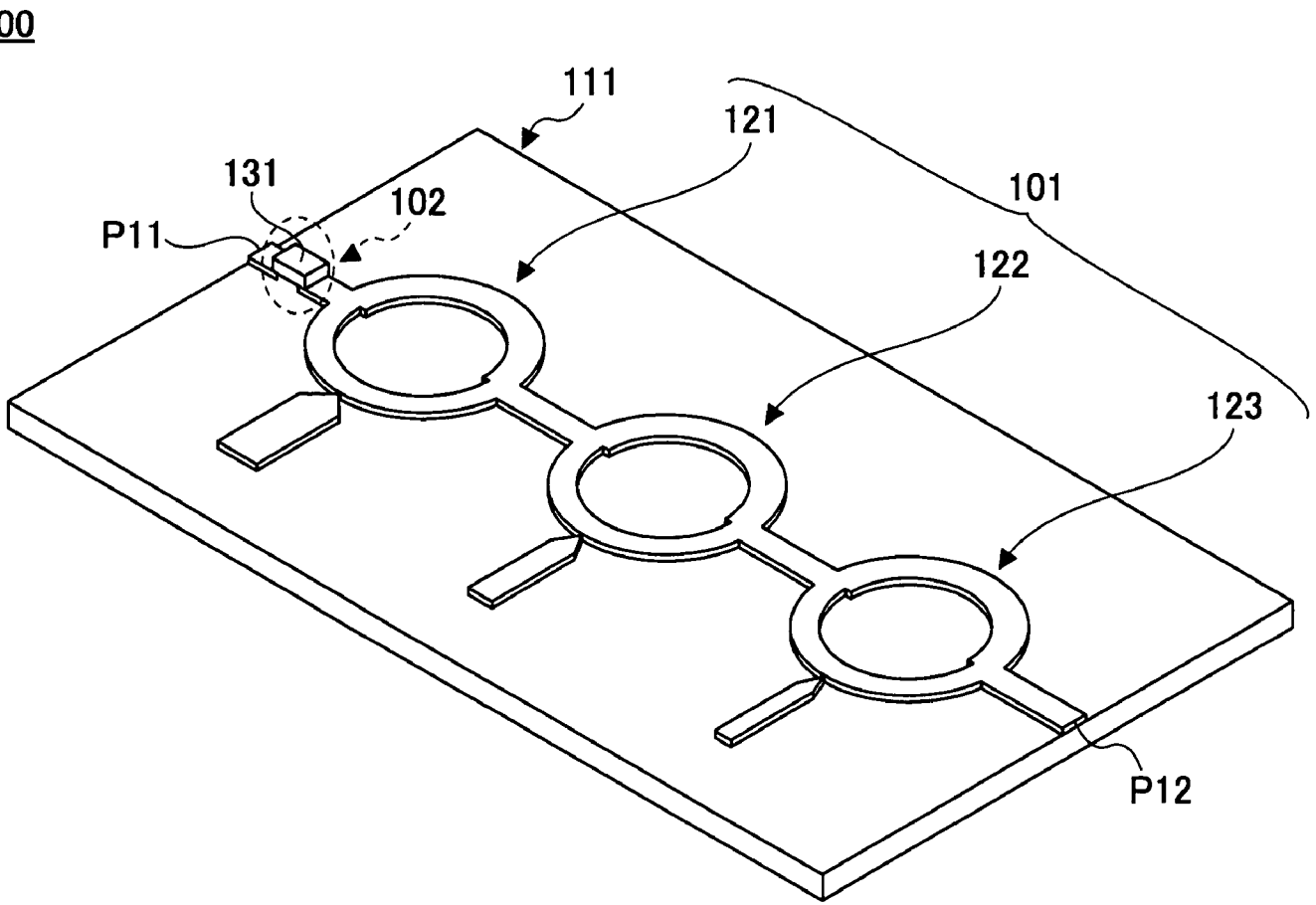
FIG. 5 is a perspective view of a filtering device 100 according to a first embodiment of the present invention.

FIG. 5 is a perspective view of a filtering device 100 according to a first embodiment of the present invention.

Figure 6:
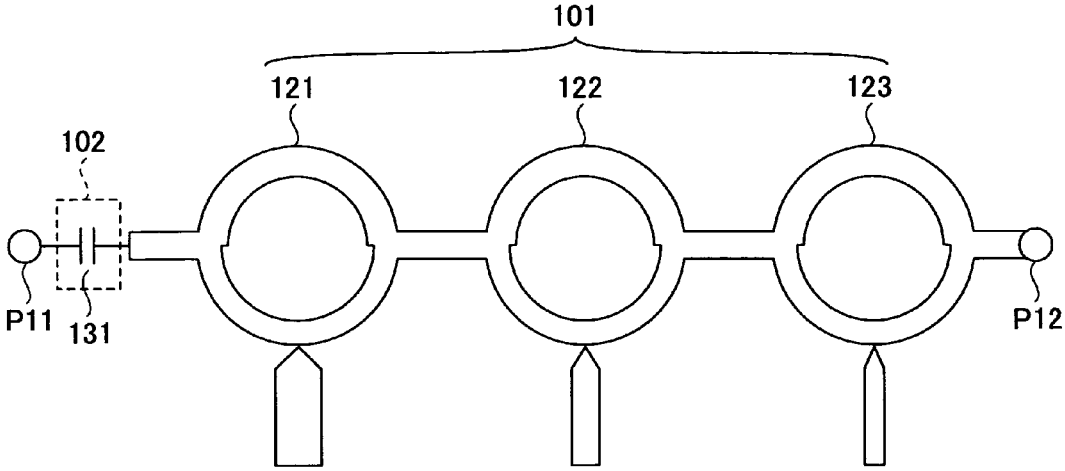
FIG. 6 is a schematic view illustrating conductive patterns of the filtering device 100 of the first embodiment.

FIG. 6 is a schematic view illustrating conductive patterns of the filtering device 100 of the present embodiment.

As illustrated in FIG. 5, the filtering device 100 has band-pass characteristics, that is, the filtering device 100 is able to pass certain frequency components of an input signal. The filtering device 100 includes a first filtering unit 101 and a second filtering unit 102, and the first filtering unit 101 and the second filtering unit 102 are arranged on a printed circuit board 111.

The first filtering unit 101 is formed from a distributed constant circuit, and is formed on the printed circuit board 111 as printed interconnection patterns. The first filtering unit 101 has band-elimination characteristics,.that is, the first filtering unit 101 is able to eliminate certain frequency components.

Figure 1:
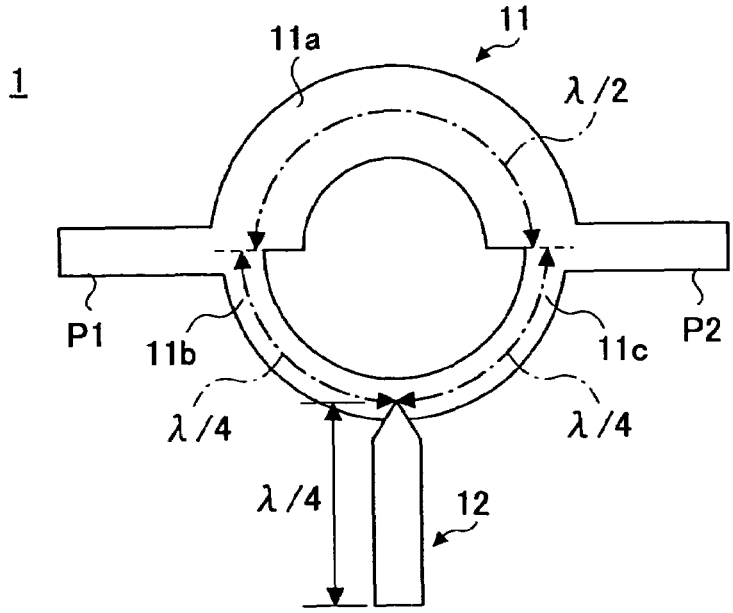
FIG. 1 is a view illustrating a structure of a ring filter.
Figure 2:
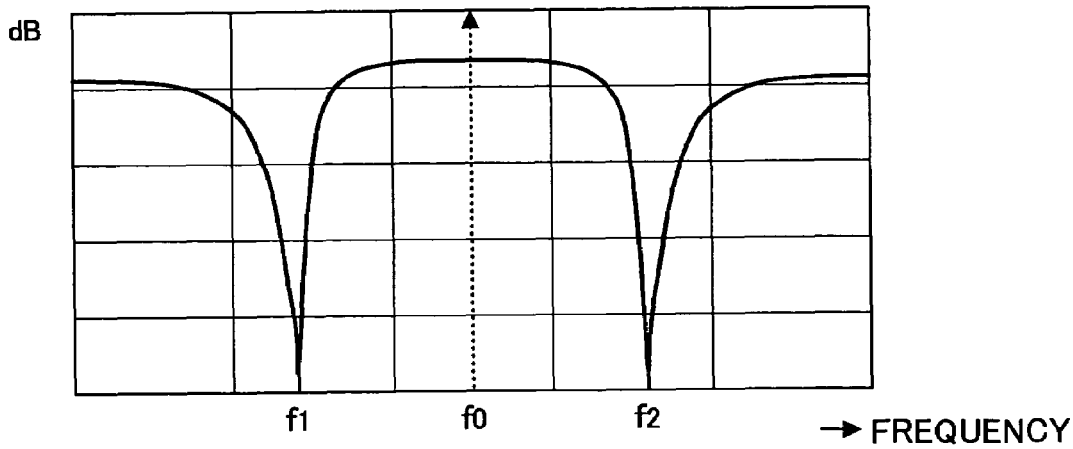
FIG. 2 shows band characteristics of the ring filter.
Figure 3:
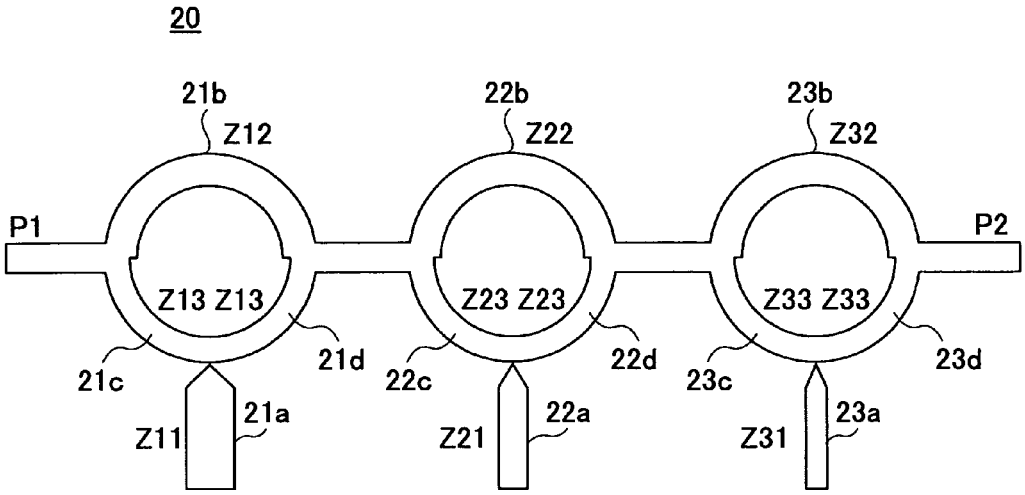
FIG. 3 is a view of a filtering device using the ring filters.

The first filtering unit 101 has the same structure as that of the filtering device 20 shown in FIG. 3. Specifically, as illustrated in FIG. 5, the first filtering unit 101 includes a first ring filter 121, a second ring filter 122, and a third ring filter 123, and each of the first ring filter 121, the second ring filter 122, and the third ring filter 123 has a stub.

The same as the filtering device 20 shown in FIG. 3, one end of the first ring filter 121 is connected to a port P11 through the second filtering unit 102, and the other end of the first ring filter 121 is connected to the second ring filter 122. One end of the second ring filter 122 is connected to the first ring filter 121, and the other end of the second ring filter 122 is connected to the third ring filter 123. One end of the third ring filter 123 is connected to the second ring filter 122, and the other end of the third ring filter 123 is connected to the port P12.

Figure 4:
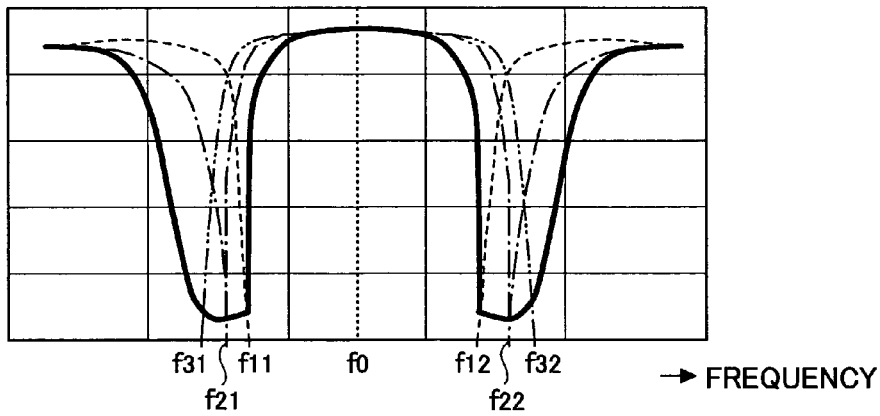
FIG. 4 shows band characteristics of the filtering device using the ring filters.

The first ring filter 121, the second ring filter 122, and the third ring filter 123 are formed on one side of the printed circuit board 111 as conductive patterns. Because of the above structure, the first filtering unit 101 exhibits the same band-elimination characteristics as that shown in FIG. 4.

The second filtering unit 102 is for attenuating components of frequencies lower than the low attenuation pole frequency in the band-elimination characteristics of the first filtering unit 101.

For example, the second filtering unit 102 is made of a chip condenser 131, and one end of the chip condenser 131 is connected to the port P11 through a printed interconnection pattern, and the other end of the chip condenser 131 is connected to the first ring filter 121. Certainly, the second filtering unit 102 is not limited to a chip condenser, but can be formed from any distributed constant circuit, for example, it can be formed from a distributed constant circuit using conductive patterns.

Figure 7:
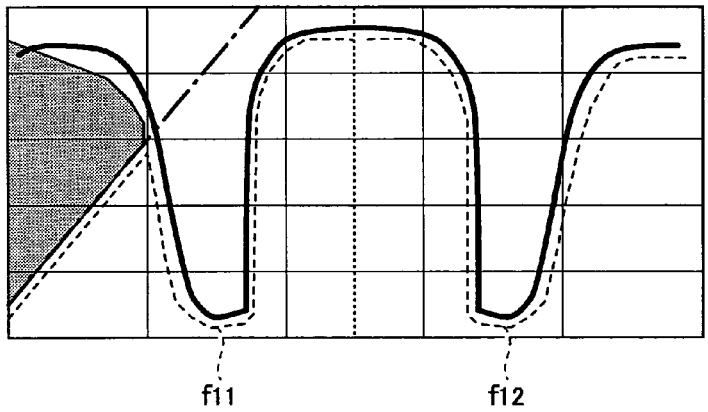
FIG. 7 shows band characteristics of the filtering device 100.

FIG. 7 shows band characteristics of the filtering device 100.

In the present embodiment, with the first filtering unit 101, the band-elimination characteristic as indicated by the dashed line in FIG. 7 is obtained, in which a low attenuation pole frequency f11 and a high attenuation pole frequency f12 are located at positions lower and higher than the desired band in FIG. 7, respectively.

In addition, with the second filtering unit 102, the high-pass characteristic as indicated by the dot-dashed line in FIG. 7 is obtained, in which signal components in the band lower than the low attenuation pole frequency f11 are attenuated.

The band characteristics of the filtering device 100 corresponds to a combination of the band-elimination characteristic of the first ring filter 121 and the high-pass characteristic of the second ring filter 122, and is shown by the solid line in FIG. 7.

In the present embodiment, the filtering device 100 is formed from the first ring filter 121, the second ring filter 122, and the third ring filter 123, and a chip condenser 131 functioning as the second filtering unit 102, which are arranged on the printed circuit board 111. Each of the first ring filter 121, the second ring filter 122, and the third ring filter 123 is furnished with a stub.

In spite of such a simple structure, the filtering device 100 shows sharp band attenuation in the region lower than the pass-band, and signal components in the band lower than the pass-band are surely removed.

Therefore, when the filtering device 100 is used as a band-pass filter in the UWB communications, it is possible to certainly reduce influence of the low band on desired signals.

In the above, it is described that one end of the chip condenser 131 is connected to the port P11, and the other end of the chip condenser 131 is connected to the first ring filter 121, but the present embodiment is not limited to this arrangement. These elements can be arranged in any way as long as the first ring filter 121, the second ring filter 122, the third ring filter 123, and the chip condenser 131 are connected in series between the port P11 and P12.

Second Embodiment

Figure 8:
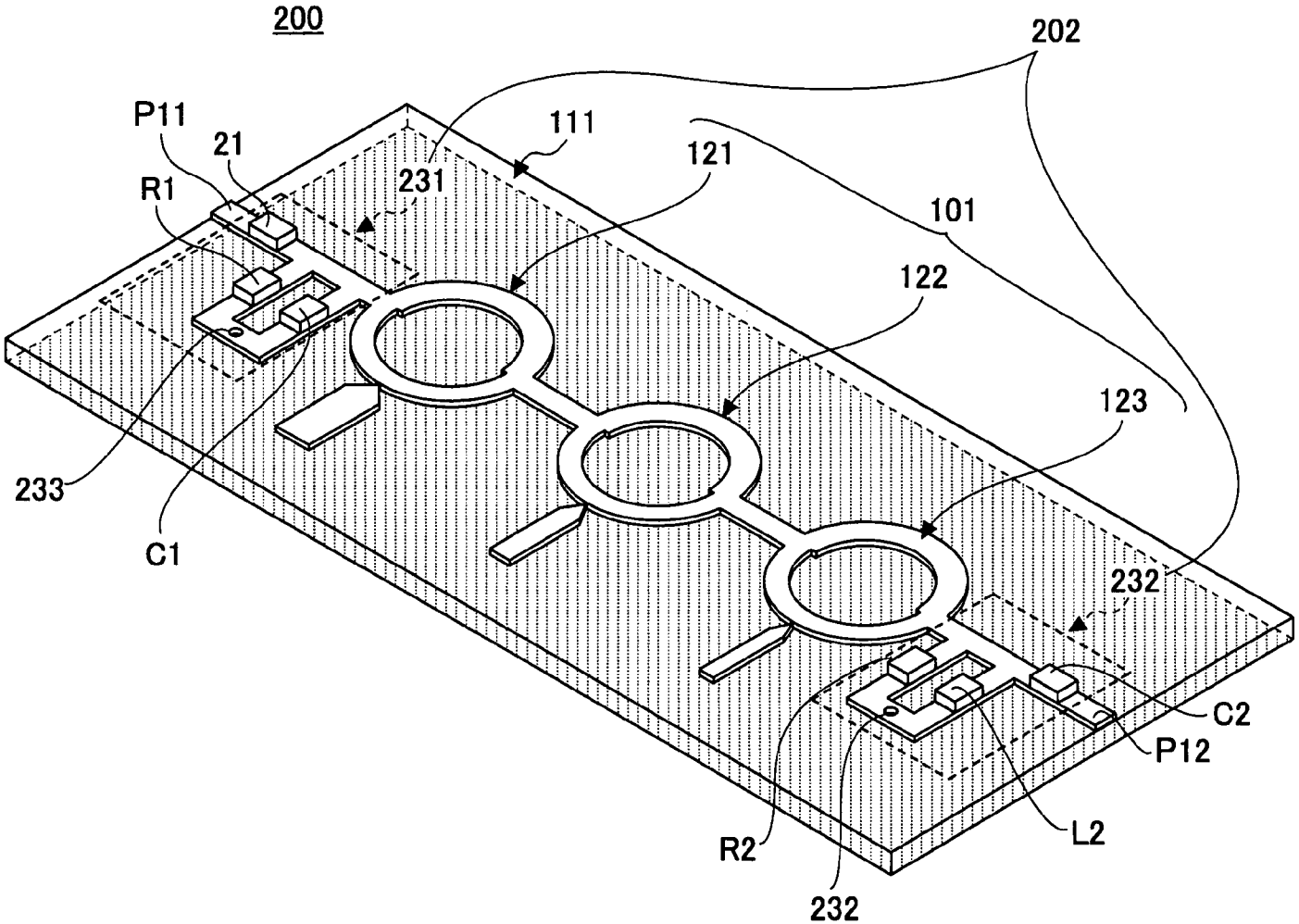
FIG. 8 is a perspective view of a filtering device 200 according to a second embodiment of the present invention.

FIG. 8 is a perspective view of a filtering device 200 according to a second embodiment of the present invention.

Figure 9:
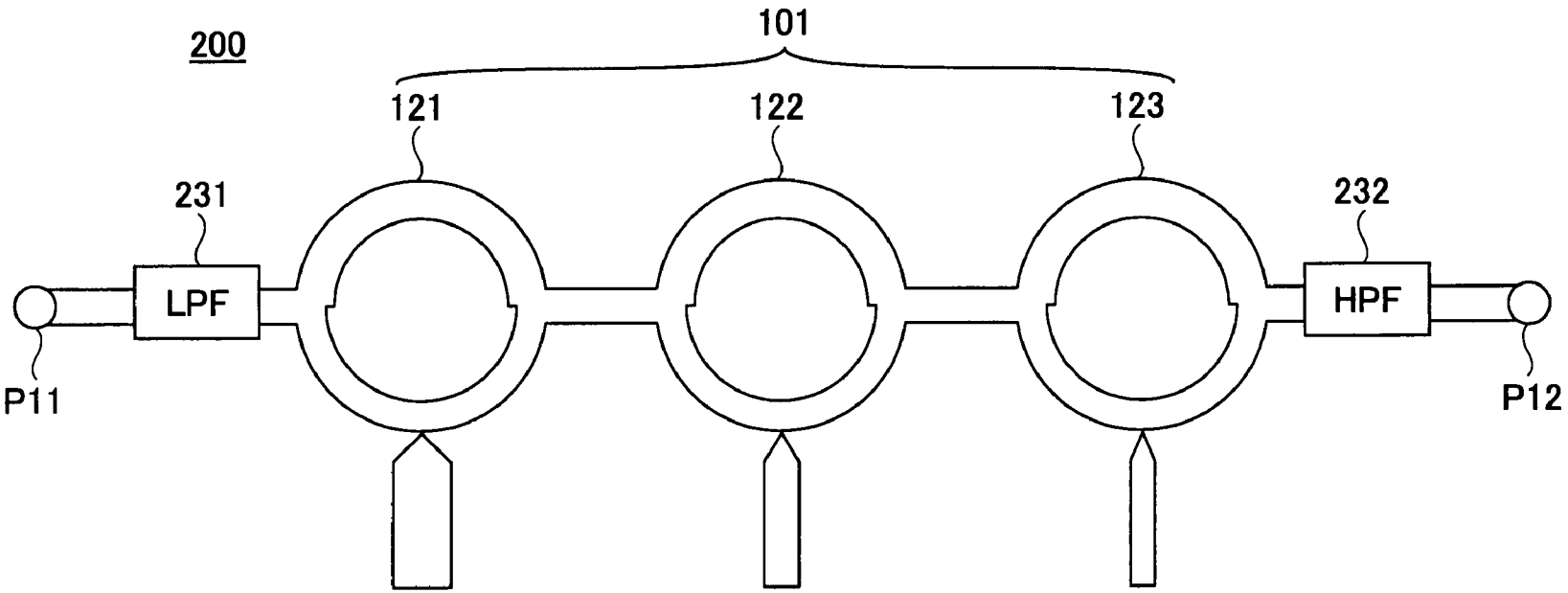
FIG. 9 is a schematic view illustrating a configuration of the filtering device 200 of the second embodiment.

FIG. 9 is a schematic view illustrating a configuration of the filtering device 200 of the present embodiment.

In the present embodiment, the same reference numbers are assigned to the same elements as those in the previous embodiments, and overlapping descriptions are omitted.

As illustrated in FIG. 8, the filtering device 200 includes the first filtering unit 101 and a second filtering unit 202, which are arranged on the printed circuit board 111.

The filtering device 200 of the present embodiment differs from the filtering device 100 of the first embodiment in that the second filtering unit 202 is different from the second filtering unit 102 in the first embodiment.

As illustrated in FIG. 8, the second filtering unit 202 includes a low-pass filter 231, and a high-pass filter 232.

The low-pass filter 231 is arranged between the port P11 and the first ring filter 121. The high-pass filter 232 is arranged between the port P12 and the third ring filter 123.

Figure 10:
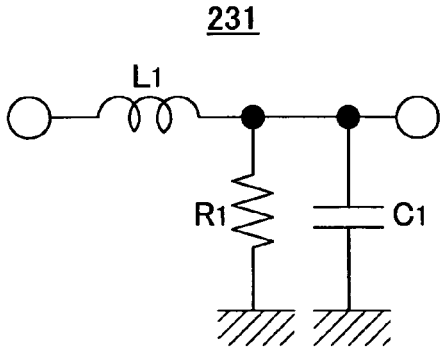
FIG. 10 is a circuit diagram of the low-pass filter 231 of the second embodiment.

FIG. 10 is a circuit diagram of the low-pass filter 231.

As illustrated in FIG. 10, the low-pass filter 231 includes an inductor L1, a resistance R1, and a capacitor C1, and is a low-pass passive filter. For example, the inductor L1, the resistance R1, and the capacitor C1 are chip parts, and are connected by printed interconnection patterns on the printed circuit board 111. Further, the resistance R1 and the capacitor C1 are connected to a grounding pattern 124 formed on the entire back side of the printed circuit board 111 through a through-hole 233.

Figure 11:
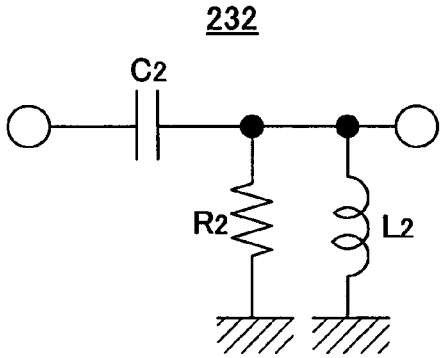
FIG. 11 is a circuit diagram of the high-pass filter 232 of the second embodiment.

FIG. 11 is a circuit diagram of the high-pass filter 232.

As illustrated in FIG. 11, the high-pass filter 232 includes a capacitor C2, a resistance R2, and an inductor L2, and is a high-pass passive filter. For example, the inductor L2, the resistance R2, and the capacitor C2 are chip parts, and are connected by printed interconnection patterns on the printed circuit board 111. Further, the resistance R1 and the capacitor C1 are connected to the grounding pattern 124 formed on the entire back side of the printed circuit board 111 through a through-hole 234.

Figure 12:
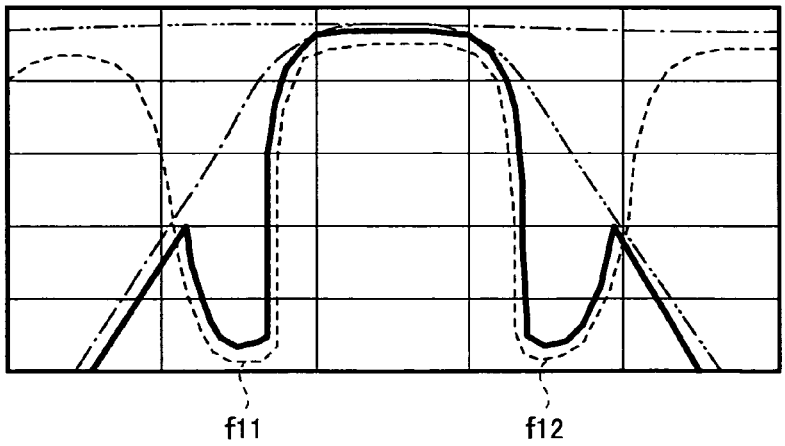
FIG. 12 shows band characteristics of the filtering device 200 of the second embodiment.

FIG. 12 shows band characteristics of the filtering device 200.

In the present embodiment, with the first filtering unit 101, the band-elimination characteristic as indicated by the dashed line in FIG. 12 is obtained, in which a low attenuation pole frequency f11 and a high attenuation pole frequency f12 are located at positions lower and higher than the desired band in FIG. 12, respectively.

In addition, with the low-pass filter 231, the low-pass characteristic as indicated by the dot-dashed line in FIG. 12 is obtained, in which signal components in the band higher than the high attenuation pole frequency f12 are attenuated. With the high-pass filter 232, the high-pass characteristic as indicated by the double-dot-dashed line in FIG. 12 is obtained, in which signal components in the band lower than the low attenuation pole frequency f11 are attenuated.

The band characteristics of the filtering device 200 corresponds to a combination of the band-elimination characteristic of the first ring filter 121, the low-pass characteristic of the low-pass filter 231, and the high-pass characteristic of the high-pass filter 232, and is shown by the solid line in FIG. 12.

In the present embodiment, the filtering device 200 is formed from the first ring filter 121, the second ring filter 122, the third ring filter 123, the low-pass filter 231, and the high-pass filter 232, which are arranged on the printed circuit board 111. Each of the first ring filter 121, the second ring filter 122, and the third ring filter 123 is furnished with a stub.

In spite of such a simple structure, the filtering device 200 shows sharp band attenuation performance on two sides of the pass-band, and signal components out of the pass-band are surely removed.

Therefore, when the filtering device 200 is used as a band-pass filter in the UWB communications, it is possible to certainly reduce influence of the signal components out of the pass-band on desired signals.

In the above, it is described that the low-pass filter 231 is arranged between the port P11 and the first ring filter 121, and the high-pass filter 232 is arranged between the port P12 and the third ring filter 123. But the present embodiment is not limited to this arrangement.

For example, the low-pass filter 231 may be arranged between the port P12 and the third ring filter 123, with the high-pass filter 232 being arranged between the port P11 and the first ring filter 121. Alternatively, the low-pass filter 231 and the high-pass filter 232 may be connected in series, and be arranged between the port P11 and the first ring filter 121. Furthermore, the low-pass filter 231 and the high-pass filter 232 may be arranged between the first ring filter 121 and the second ring filter 122, or between the second ring filter 122 and the third ring filter 123.

In other words, as long as the first ring filter 121, the second ring filter 122, the third ring filter 123, the low-pass filter 231, and the high-pass filter 232 are connected in series between the port P11 and P12, these elements can be arranged in any way.

Third Embodiment

Figure 13:
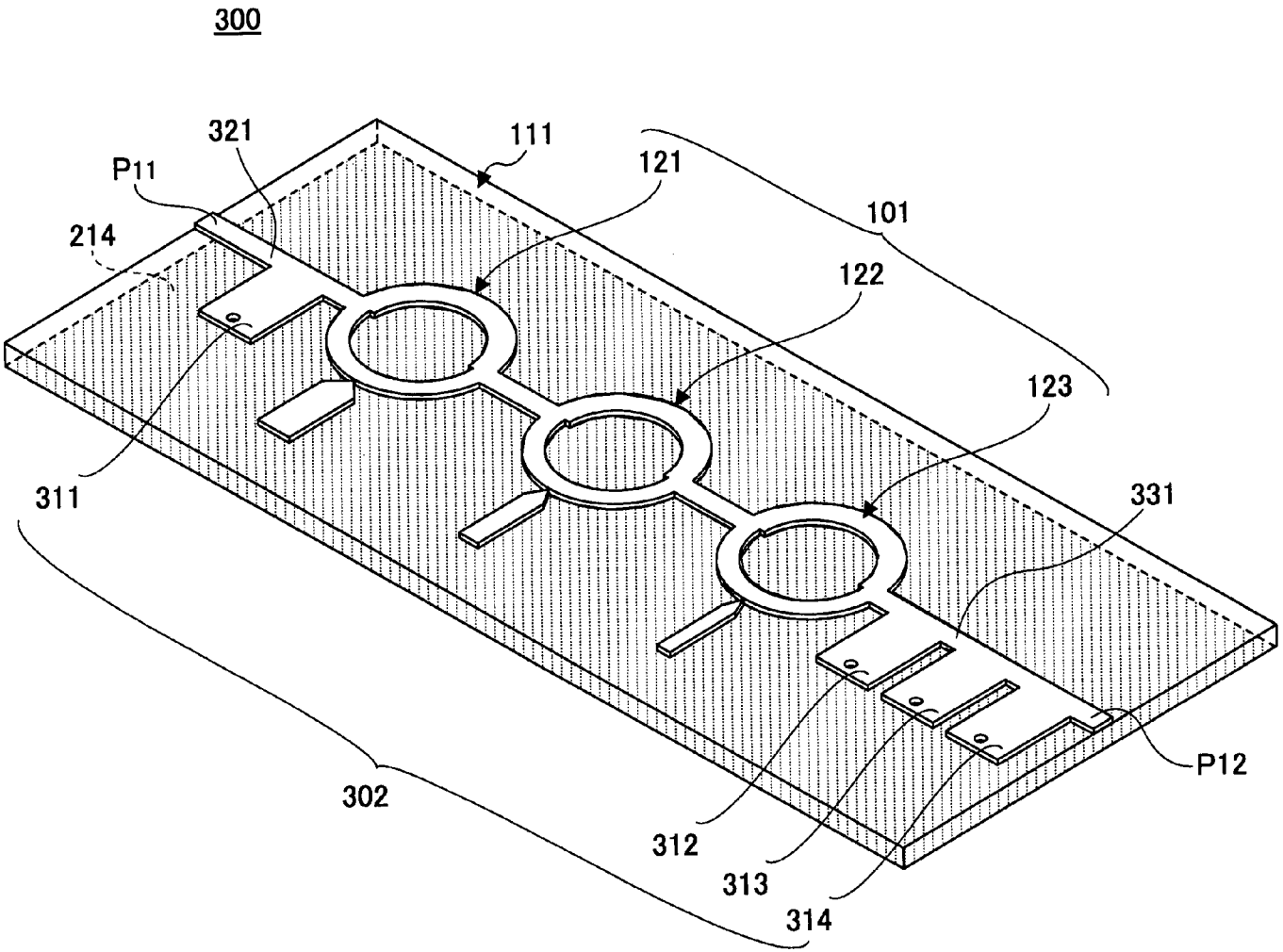
FIG. 13 is a perspective view of a filtering device 300 according to a third embodiment of the present invention.

FIG. 13 is a perspective view of a filtering device 300 according to a third embodiment of the present invention.

Figure 14:
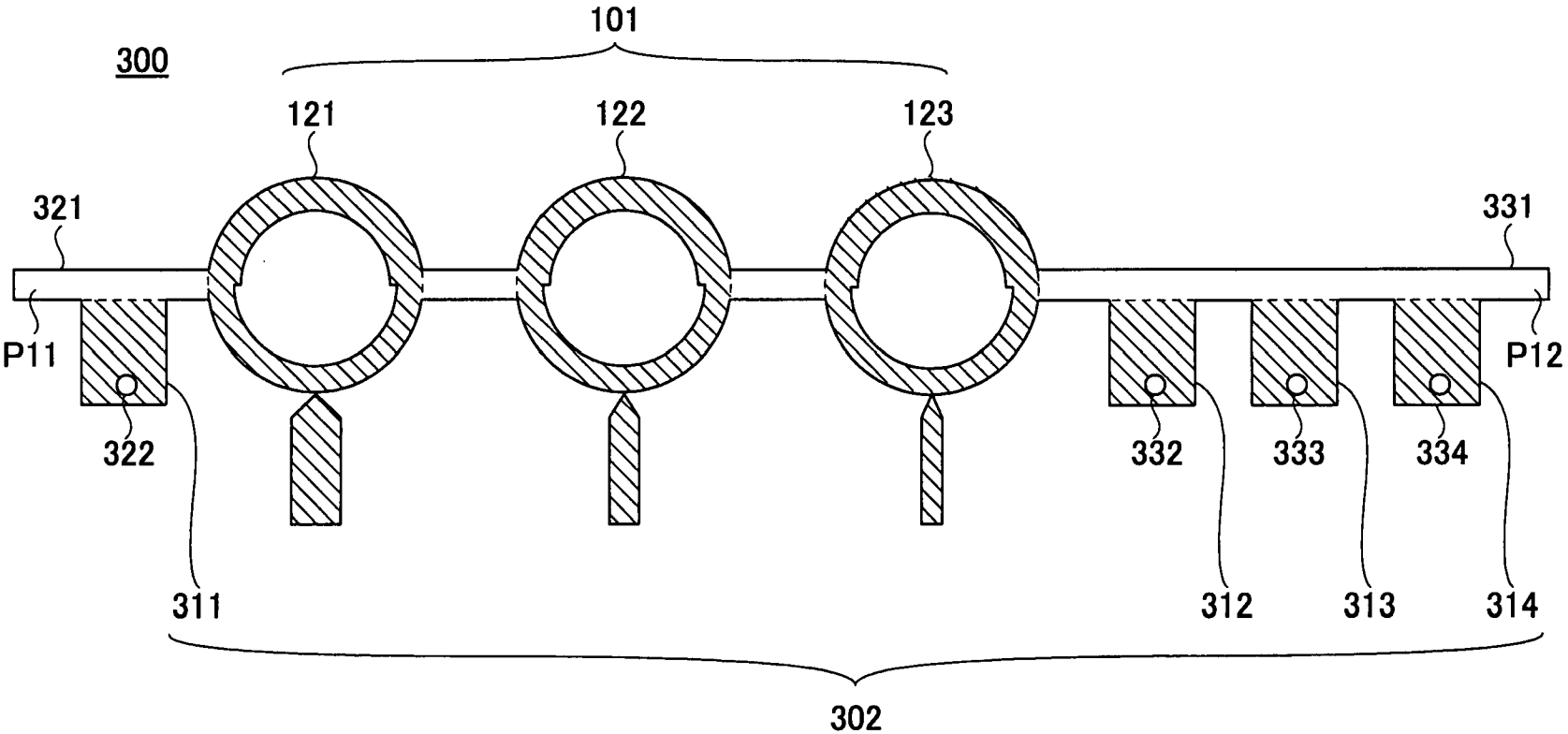
FIG. 14 is a schematic view illustrating a configuration of the filtering device 300 of the third embodiment.

FIG. 14 is a schematic view illustrating a configuration of the filtering device 300 of the present embodiment.

In the present embodiment, the same reference numbers are assigned to the same elements as those in the previous embodiments, and overlapping descriptions are omitted.

As illustrated in FIG. 8, the filtering device 300 includes the first filtering unit 101 and a second filtering unit 302, which are arranged on the printed circuit board 111.

The filtering device 300 of the present embodiment differs from the filtering device 100 of the first embodiment in that the second filtering unit 302 is different from the second filtering unit 102 in the first embodiment. In the filtering device 300, the second filtering unit 302 is formed from short studs 311 through 314, which constitute a distributed constant circuit.

Figure 15:
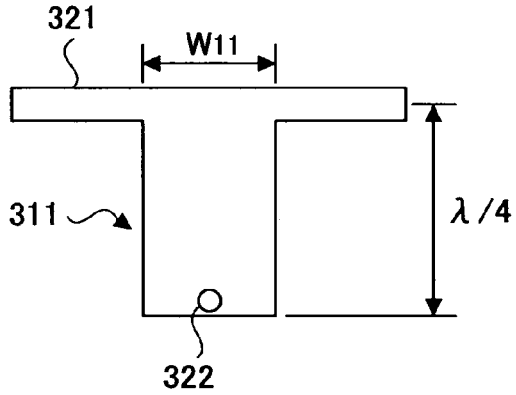
FIG. 15 is a schematic view illustrating a configuration of the short stud 311 of the third embodiment.

FIG. 15 is a schematic view illustrating a configuration of the short stud 311.

As illustrated in FIG. 15, one end of the short stud 311 is connected with an interconnection pattern 321, which connects the first ring filter 121 and the port P11, and the other end of the short stud 311 is connected to the grounding pattern 124 formed on the entire back side of the printed circuit board 111 through a through-hole 322. The width of the short stud 311 is set to be W11, and the length of the short stud 311 is set to be roughly equal to $\lambda/4$. Here, $\lambda$ is the wavelength corresponding to the central frequency f0 of the desired band.

Similarly, one end of the short stud 312 is connected with an interconnection pattern 331, which connects the third ring filter 123 and the port P12, and the other end of the short stud 312 is connected to the grounding pattern 124 formed on the entire back side of the printed circuit board 111 through a through-hole 332. The width of the short stud 312 is denoted to be W12, and the length of the short stud 312 is set to be roughly equal to $\lambda/4$.

One end of the short stud 313 is connected with the interconnection pattern 331, which connects the third ring filter 123 and the port P12, and the other end of the short stud 313 is connected to the grounding pattern 124 formed on the entire back side of the printed circuit board 111 through a through-hole 333. The width of the short stud 313 is denoted to be W13, and the length of the short stud 313 is set to be roughly equal to $\lambda/4$.

One end of the short stud 314 is connected with the interconnection pattern 331, which connects the third ring filter 123 and the port P12, and the other end of the short stud 314 is connected to the grounding pattern 124 formed on the entire back side of the printed circuit board 111 through a through-hole 334. The width of the short stud 314 is denoted to be W14, and the length of the short stud 314 is set to be roughly equal to $\lambda/4$.

The widths and lengths of the short studs 311 through 314 can be appropriately adjusted corresponding to the desired band characteristics.

Figure 16:
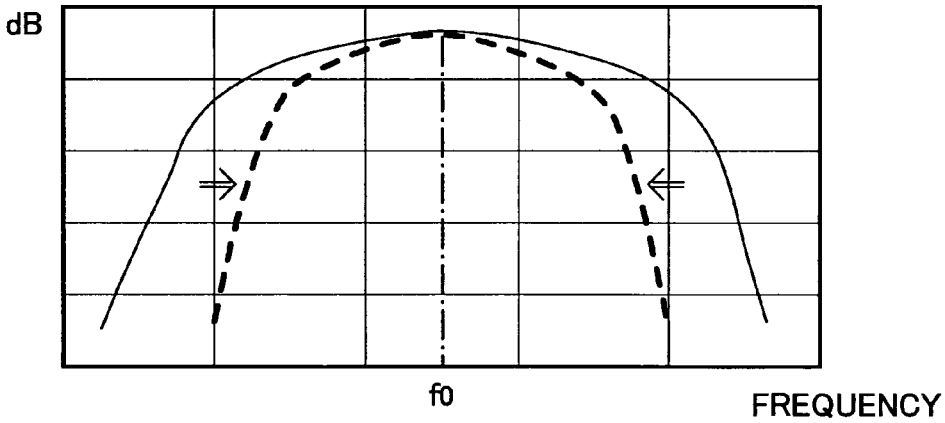
FIG. 16 shows dependence of the band characteristic of a short stub on the impedance of the short stub.

FIG. 16 shows dependence of the band characteristic of a short stub on the impedance of the short stub.

When the width of the short stub is increased, the impedance of the short stub decreases, and the band characteristic of the short stub changes from the one indicated by the solid line to the one indicated by the dashed line. That is, the pass-band gradually becomes narrow, as indicated by the arrows in FIG. 16, in response to decrease of the impedance of the short stub.

Figure 17:
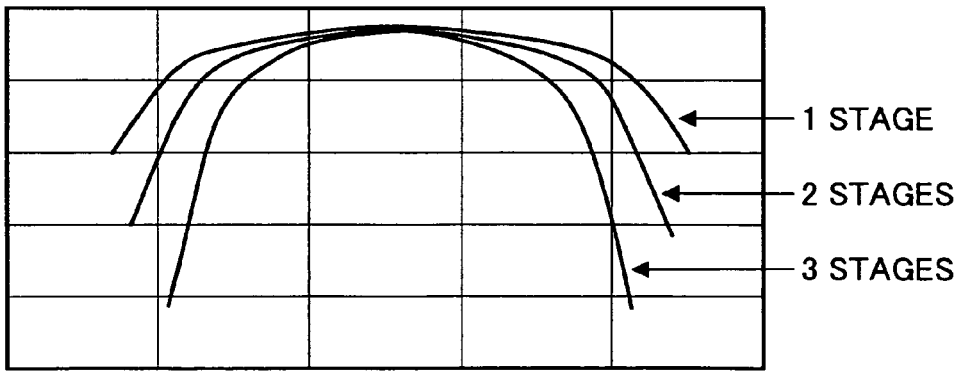
FIG. 17 shows dependence of the band characteristic of a short stub on the stage number of short stubs connected in series.

FIG. 17 shows dependence of the band characteristic of a short stub on the stage number of short stubs connected in series.

When the stage number of short stubs connected in series is increased, attenuation of the stop-band increases, and as shown in FIG. 17, the pass-band becomes sharp gradually.

In other words, the band characteristic of the second filtering unit 302 can be controlled by adjusting the width, length of the short stub, and stage number of the short stubs connected in series. Because the short stub shows the band characteristics of a band-pass filter, as illustrated in FIG. 16 and FIG. 17, if plural narrow short stubs are arranged in series, band-pass characteristics in a wide-band and showing sharp attenuation performance are obtainable. Nevertheless, in this case, since the short stubs should be arranged at intervals of λ/4, in order to obtain the band characteristics required by the UWB communication scheme, a large stage number is needed, and this increases the area of the substrate.

In the present embodiment, the first filtering unit 101 is formed from three-stage ring filters each having a stub, and results in band-pass characteristics in a wide band and showing sharp attenuation performance. In addition, the second filtering unit 302, which is formed from four-stage short stubs 311 through 314, attenuates components below the low attenuation pole frequency and components above the high attenuation pole frequency in the band-elimination characteristics produced by the first filtering unit 101. As a result, it is possible to obtain band-pass characteristics in a wide band and showing sharp attenuation performance while maintaining the device to be compact.

Figure 18:
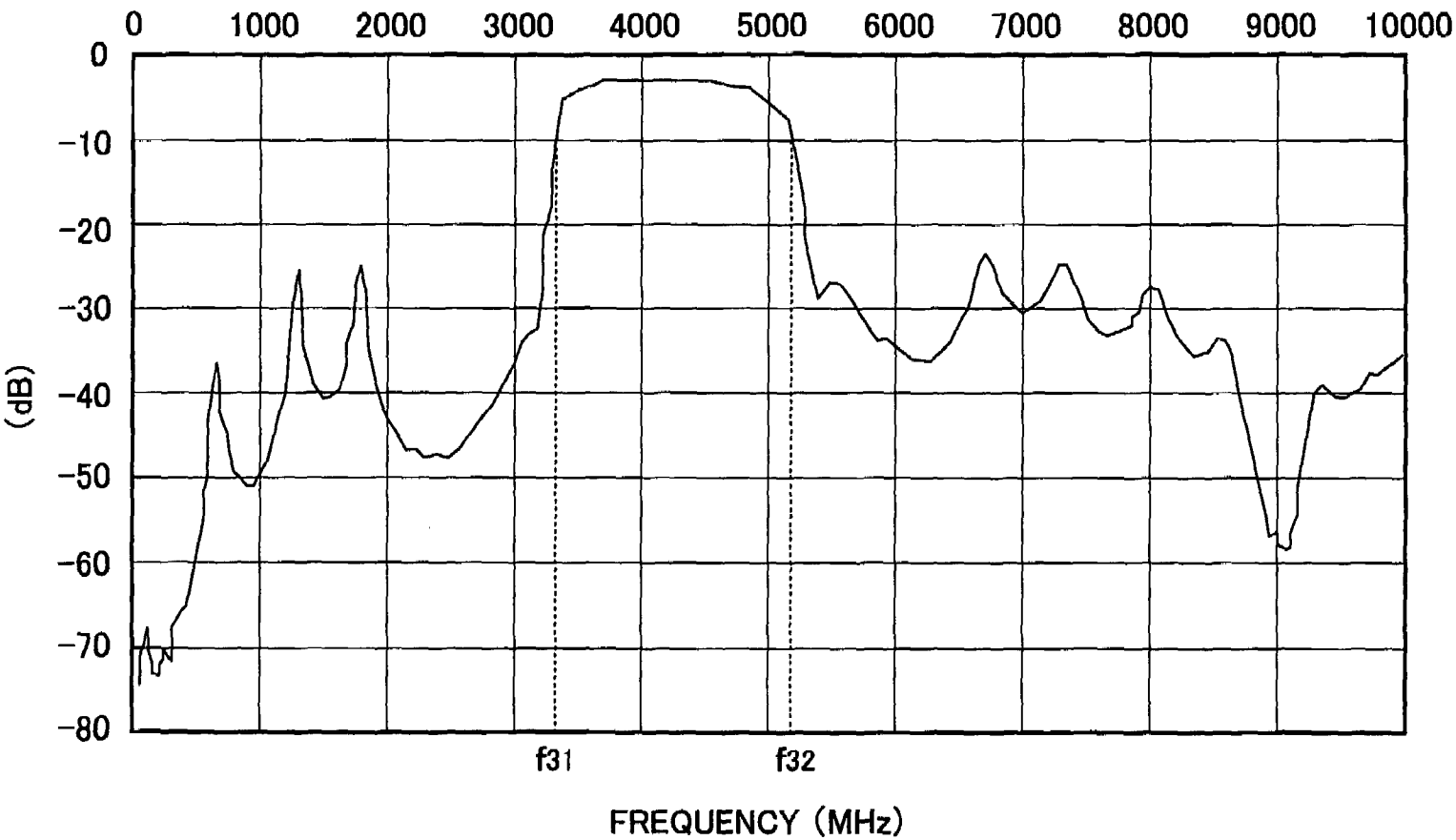
FIG. 18 shows the band characteristics of the filtering device 300 of the third embodiment.

FIG. 18 shows the band characteristics of the filtering device 300.

As illustrated in FIG. 18, according to the filtering device 300 of the present embodiment, it is possible to obtain band-pass characteristics showing sharp attenuation performance in a wide band of about 2000 MHz from the low attenuation pole frequency f31 to the high attenuation pole frequency f32.

Figure 19:
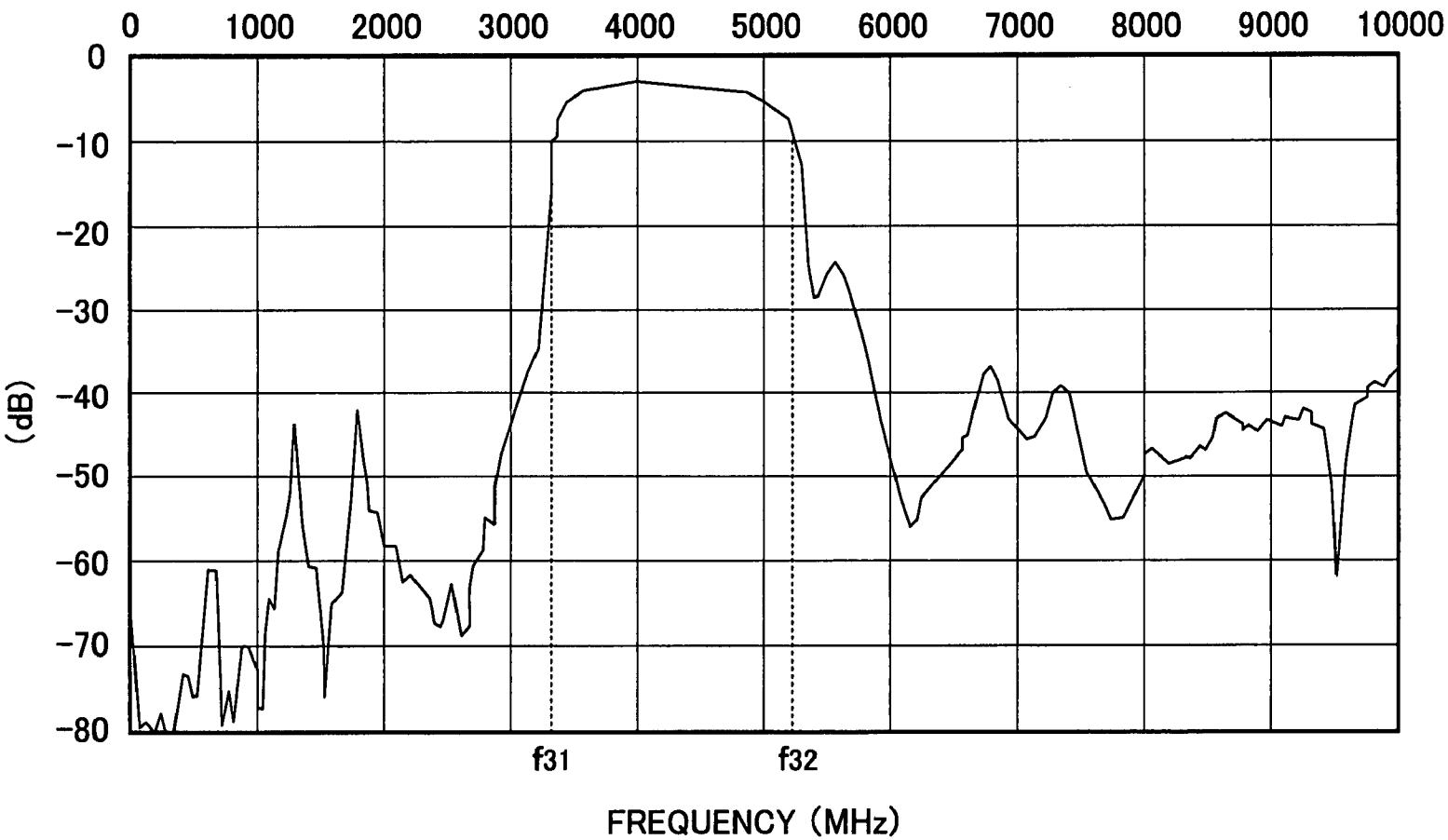
FIG. 19 shows the band characteristic of the filtering device 300 of the third embodiment when the second filtering unit 302 includes six stages of short stubs.

FIG. 19 shows the band characteristic of the filtering device 300 when the second filtering unit 302 includes six stages of short stubs.

As illustrated in FIG. 19, when the stage number of the short stubs in the second filtering unit 302 is increased to six, the stop-bands are attenuated strongly and sharply.

It should be noted that the short stubs of the second filtering unit 302 may also be arranged between the ring filters of the first filtering unit 101, as long as intervals between the short stubs or intervals between the short stubs and the ring filters are roughly λ/4.

In addition, the arrangement direction of the short stubs is not limited to one direction. Further, the arrangement of the short stubs is not limited to a linear arrangement, but may also be arranged along a curve, or along a folded line.

Fourth Embodiment

Figure 20:
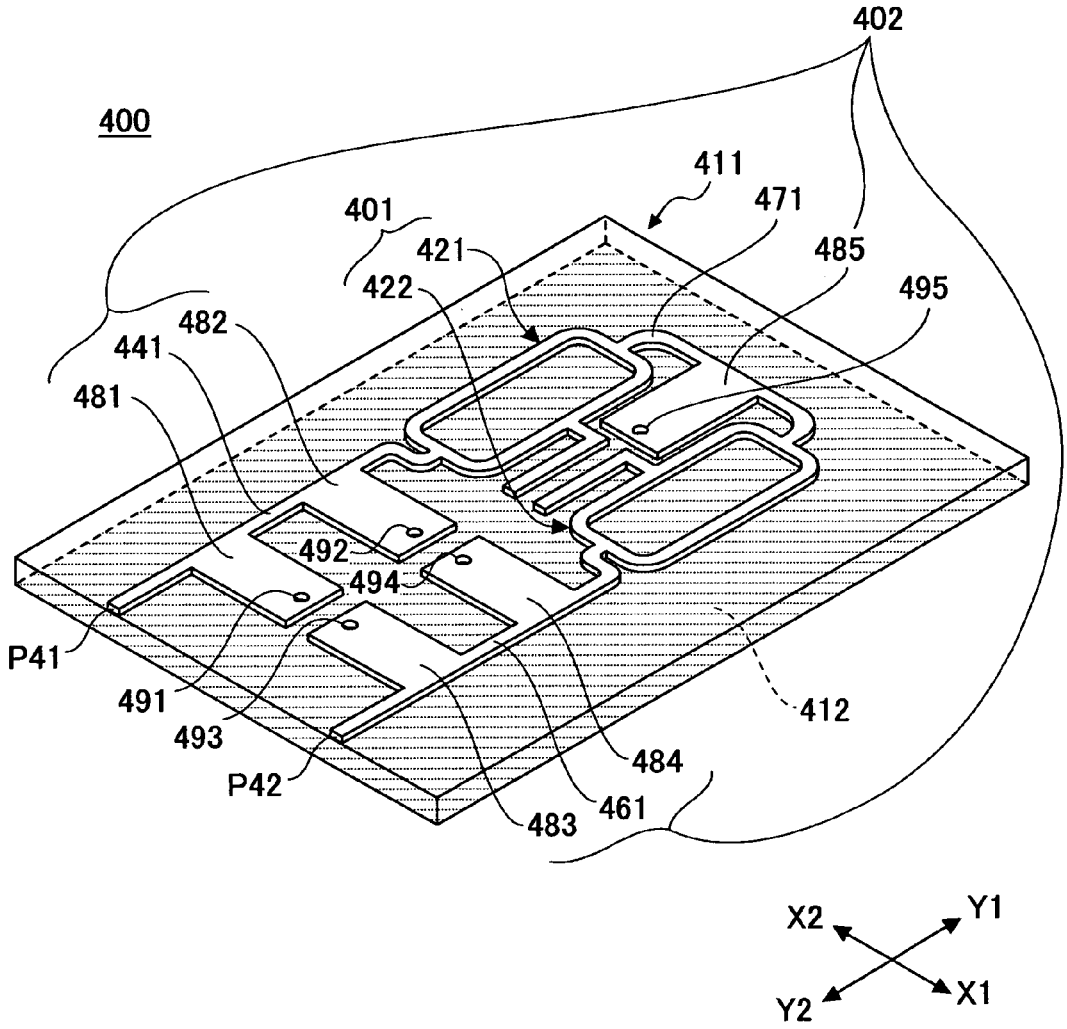
FIG. 20 is a perspective view of a filtering device 400 according to a fourth embodiment of the present invention.

FIG. 20 is a perspective view of a filtering device 400 according to a fourth embodiment of the present invention.

As illustrated in FIG. 20, the filtering device 400 includes a first filtering unit 401 and a second filtering unit 402, which are conductive patterns arranged on a printed circuit board 411.

Figure 21:
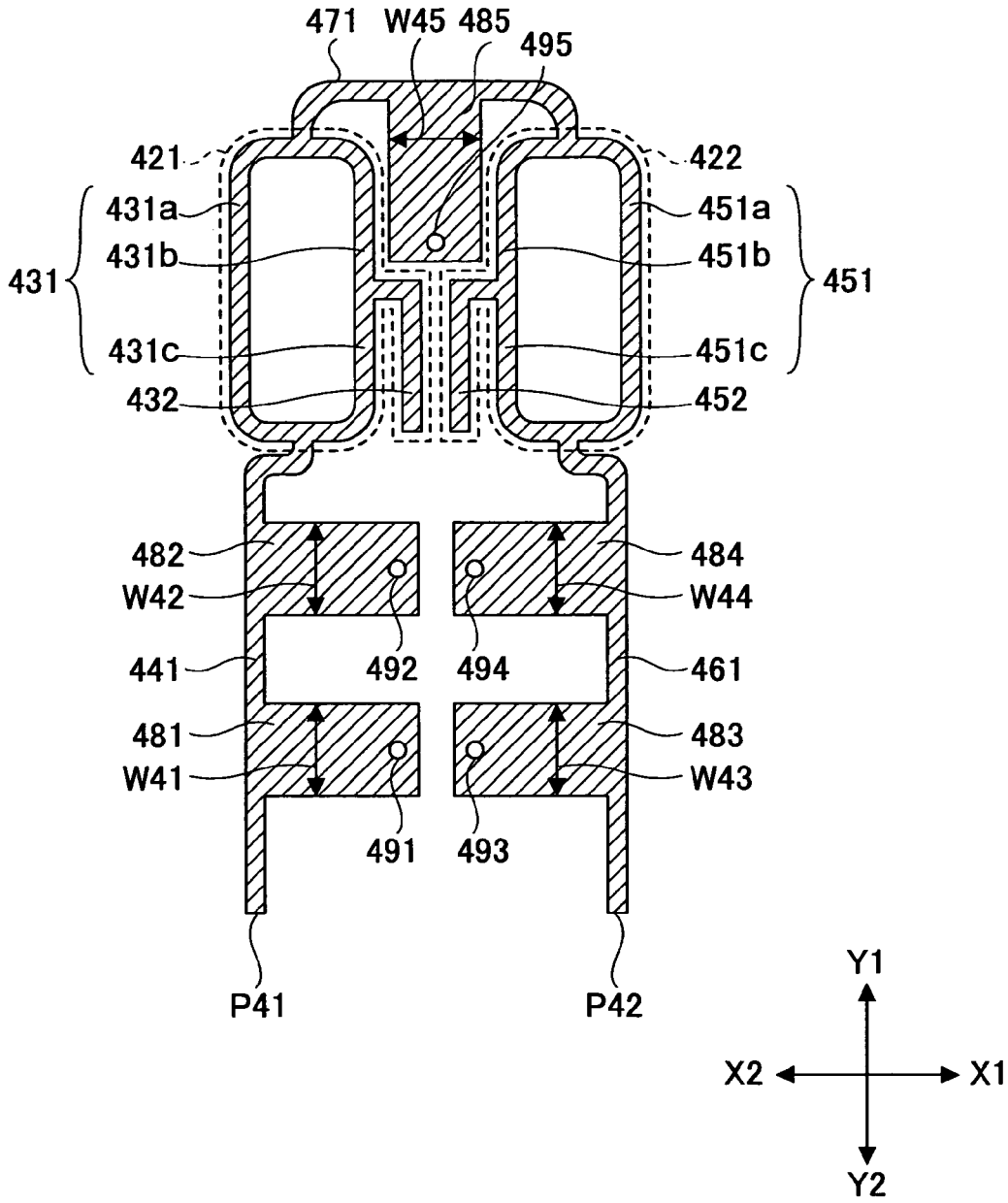
FIG. 21 is a plan view illustrating a configuration of the filtering device 400 of the fourth embodiment.

FIG. 21 is a plan view illustrating a configuration of the filtering device 400.

As illustrated in FIG. 20 and FIG. 21, the first filtering unit 401 includes a first ring filter 421, a second ring filter 422, each of which has a stub.

The first ring filter 421 includes a ring portion 431 and an open stub 432. The ring portion 431 includes a λ/2 path portion 431*a*, a first λ/4 path portion 431*b*, and a second λ/4 path portion 431*c*. The first ring filter 421 has nearly an elliptic shape, with a long side along the Y1-Y2 direction, and a short side along the X1-X2 direction. Because of such a shape, the width spread in the X1-X2 direction is reduced.

The length of the open stub 432 is set to be approximately λ/4. The open stub 432 has a folded shape, including a first portion extending in the X1 direction from the connecting point of the first λ/4 path portion 431*b* and the second λ/4 path portion 431*c*, and a second portion extending in the Y2 direction. The first ring filter 421 is connected to a port P41 through a first interconnection pattern 441 which extends in the Y2 direction.

The second ring filter 422 includes a ring portion 451 and an open stub 452. The ring portion 451 includes a λ/2 path portion 451*a*, a first λ/4 path portion 451*b*, and a second λ/4 path portion 451*c*. The second ring filter 422 has nearly an elliptic shape, with a long side along the Y1-Y2 direction, and a short side along the X1-X2 direction. Because of such a shape, the width spread in the X1-X2 direction is reduced.

The length of the open stub 452 is set to be approximately λ/4. The open stub 452 has a folded shape, including a first portion extending in the X2 direction from the connecting point of the first λ/4 path portion 451*b* and the second λ/4 path portion 451*c*, and a second portion extending in the Y2 direction. The second ring filter 422 is connected to a port P42 through a second interconnection pattern 461 which extends in the Y2 direction.

The first ring filter 421 and the second ring filter 422 are connected by a third interconnection pattern 471. The third interconnection pattern 471 has a folded shape, which includes portions extending in the Y1 direction and connecting to the first ring filter 421 and the second ring filter 422, respectively, and a portion extending in the X direction. Namely, the third interconnection pattern 471 is folded from the Y1 direction back to the Y2 direction, due to such a shape, the port P41, P42 can be arranged on the side of the printed circuit board 411 in the Y2 direction.

The second filtering unit 402 is for attenuating components of frequencies lower than the low attenuation pole frequency in the band-elimination characteristics of the first filtering unit 401. The second filtering unit 402 is formed from five short stubs 481 through 485.

The short stud 481 is connected to the first interconnection pattern 441 at a position close to the port P41. The short stud 481 extends in the X1 direction and has a length of nearly λ/4. The width of the short stud 481 is set to be W41. The end of the short stud 481 is connected to a grounding pattern 412 formed on the entire back side of the printed circuit board 411 through a through-hole 491.

The short stud 482 is connected to the first interconnection pattern 441 at a position shifted by a distance of λ/4 in the Y1 direction from the connecting position of the short stud 481 and the first interconnection pattern 441. The short stud 482 extends in the X1 direction and has a length of nearly λ/4. The width of the short stud 482 is set to be W42. One end of the short stud 482 is connected to the grounding pattern 412 formed on the entire back side of the printed circuit board 411 through a through-hole 492.

The short stud 483 is connected to the second interconnection pattern 461 at a position close to the port P61. The short stud 483 extends in the X2 direction and has a length of nearly λ/4. The width of the short stud 483 is set to be W43. One end of the short stud 483 is connected to the grounding pattern 412 formed on the entire back side of the printed circuit board 411 through a through-hole 493.

The short stud 484 is connected to the second interconnection pattern 461 at a position shifted by a distance of λ/4 in the Y1 direction from the connecting position of the short stud 483 and the second interconnection pattern 461. The short stud 484 extends in the X2 direction and has a length of nearly λ/4. The width of the short stud 484 is set to be W44. One end of the short stud 484 is connected to the grounding pattern 412 formed on the entire back side of the printed circuit board 411 through a through-hole 494.

The short stud 485 is connected to the center of the third interconnection pattern 471. The short stud 485 extends in the Y2 direction and has a length of nearly λ/4. The width of the short stud 485 is set to be W45. One end of the short stud 485 is connected to the grounding pattern 412 formed on the entire back side of the printed circuit board 411 through a through-hole 495.

The widths and lengths of the short studs 481 through 485 can be appropriately adjusted corresponding to the desired band characteristics.

In the present embodiment, because the folded shape of the interconnection pattern 471, the filtering device 400 can be made compact, and can be installed in communication devices easily.

Figure 22:
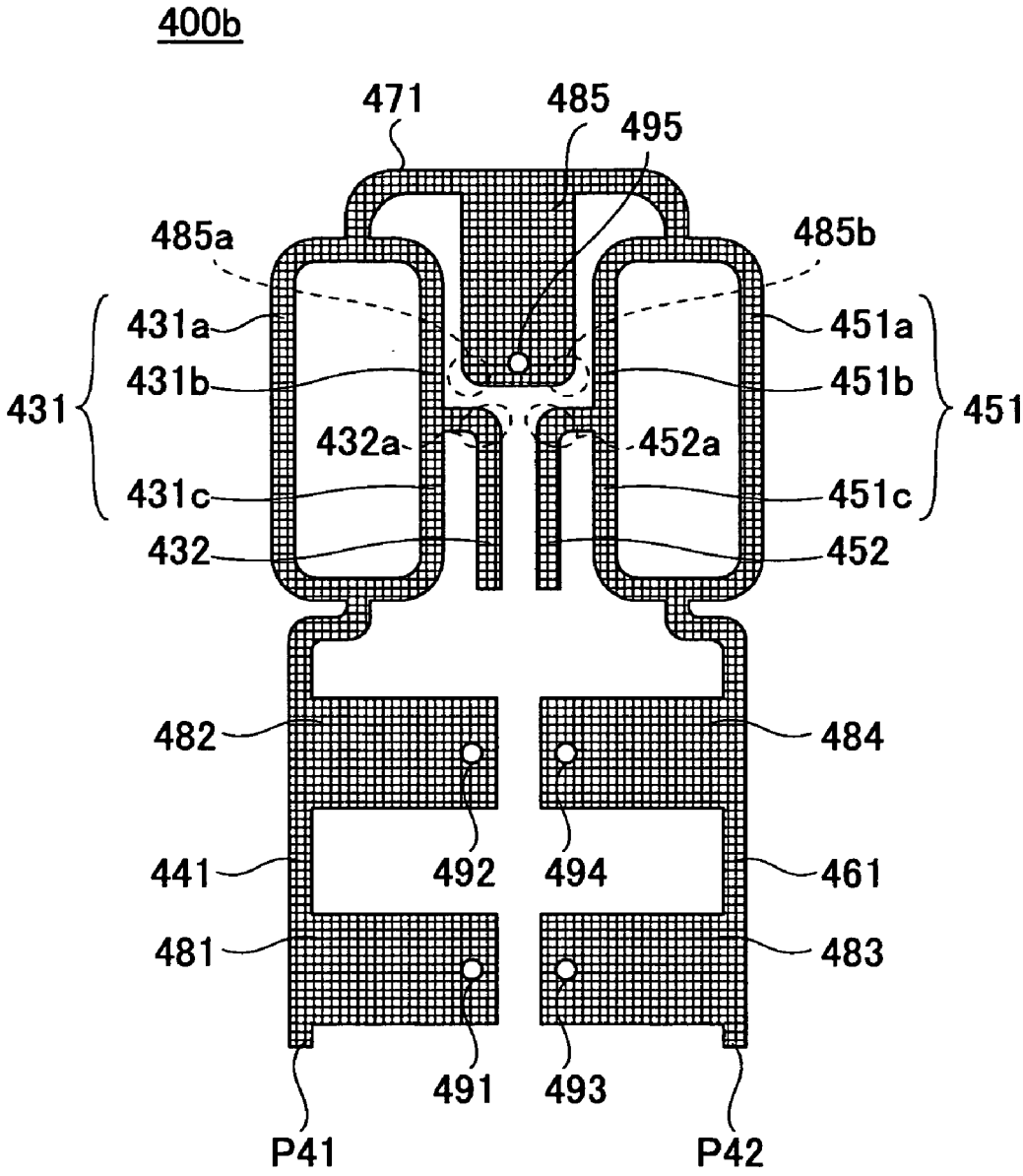
FIG. 22 is a plan view illustrating a configuration of a filtering device 400*b*, as a modification of the filtering device 400.

FIG. 22 is a plan view illustrating a configuration of a filtering device 400*b*, as a modification of the filtering device 400. In FIG. 22, the same reference numbers are assigned to the same elements as those in FIG. 20 and FIG. 21, and overlapping descriptions are omitted.

In FIG. 22, a corner 432*a* of the open stub 432 of the first ring filter 421, a corner 452*a* of the open stub 452 of the second ring filter 422, and corners 485*a* and 485*b* of the short stub 485 are rounded to have arc shapes. Because of the smooth arc shape of these corners, electromagnetic interactions between these corners are reduced, and this makes it easy to obtain the desired characteristics.

In addition to the arc shape, the above corners may also be shaped to have a polygonal shape.

Fifth Embodiment

Figure 23A:
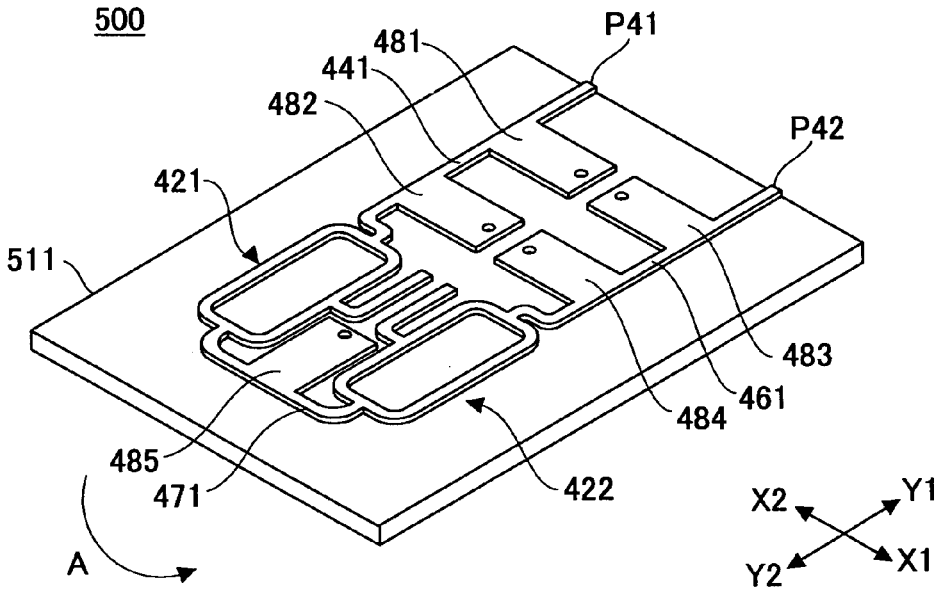
FIG. 23A is a perspective view of a filtering device 500 in an expanded state according to a fifth embodiment of the present invention.

FIG. 23A is a perspective view of a filtering device 500 in an expanded state according to a fifth embodiment of the present invention.

Figure 23B:
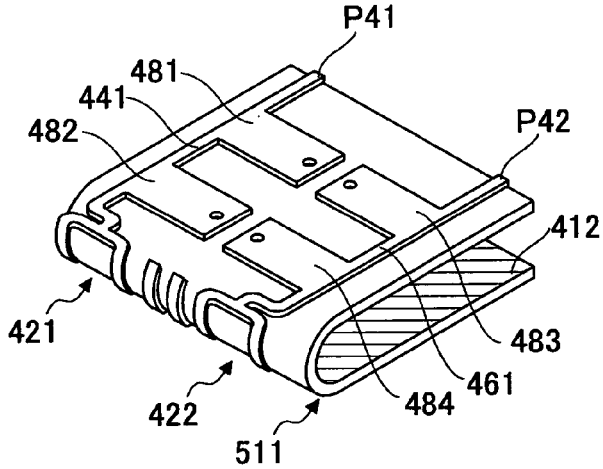
FIG. 23B is a perspective view of the filtering device 500 in a folded state according to the fifth embodiment of the present invention.

FIG. 23B is a perspective view of the filtering device 500 in a folded state according to the present embodiment of the present invention.

Figure 23C:
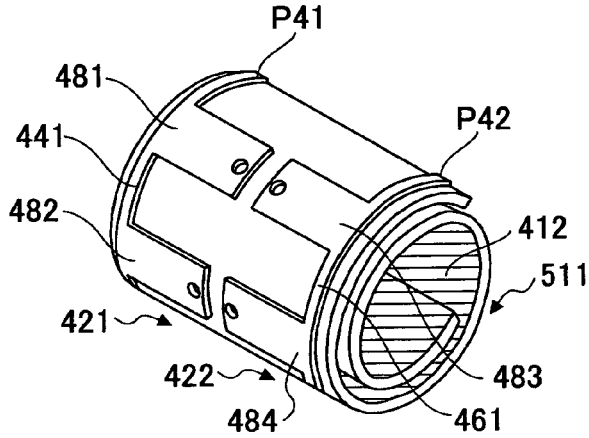
FIG. 23C is a perspective view of the filtering device 500 in a rolled state according to the fifth embodiment of the present invention.

FIG. 23C is a perspective view of the filtering device 500 in a rolled state according to the present embodiment of the present invention.

In the present embodiment, the same reference numbers are assigned to the same elements as those in FIG. 20 and FIG. 21, and overlapping descriptions are omitted.

As illustrated in FIG. 20 and FIG. 23A, the filtering device 500 includes the first filtering unit 401 and the second filtering unit 402, which are arranged on a flexible printed circuit board 511 instead of the printed circuit board 411 in the previous embodiment.

In FIG. 23B, the end of the flexible printed circuit board 511 on Y2 side is folded back along an arrow A as indicated in FIG. 23A.

In FIG. 23C, the flexible printed circuit board 511 on the Y2 side is rolled.

Because of the flexible printed circuit board 511, on which the filtering device 500 including the first filtering unit 401 and the second filtering unit 402 are mounted, the filtering device 500 can be made quite compact by folding or rolling the flexible printed circuit board 511, and improving the degrees of freedom of arrangement.

As illustrated in FIG. 23B, by folding the flexible printed circuit board 511 with the grounding pattern 412 on the back side of the flexible printed circuit board 511 being the inner side, it is possible to prevent interference between the first ring filter 421, the second ring filter 422, and the short stubs 481 through 485, making it easy to obtain the desired characteristics.

In addition, because the first interconnection pattern 441 and the second interconnection pattern 461 can be exposed to the outside, the ports P41 and P61 can also be exposed to the outside, hence, it is easy to mount the filtering device 500 to other printed circuit boards outside.

Further, with an insulating film being adhered to the flexible printed circuit board 511, the flexible printed circuit board 511 may also be rolled, as illustrated in FIG. 23C.

Sixth Embodiment

Figure 24A:
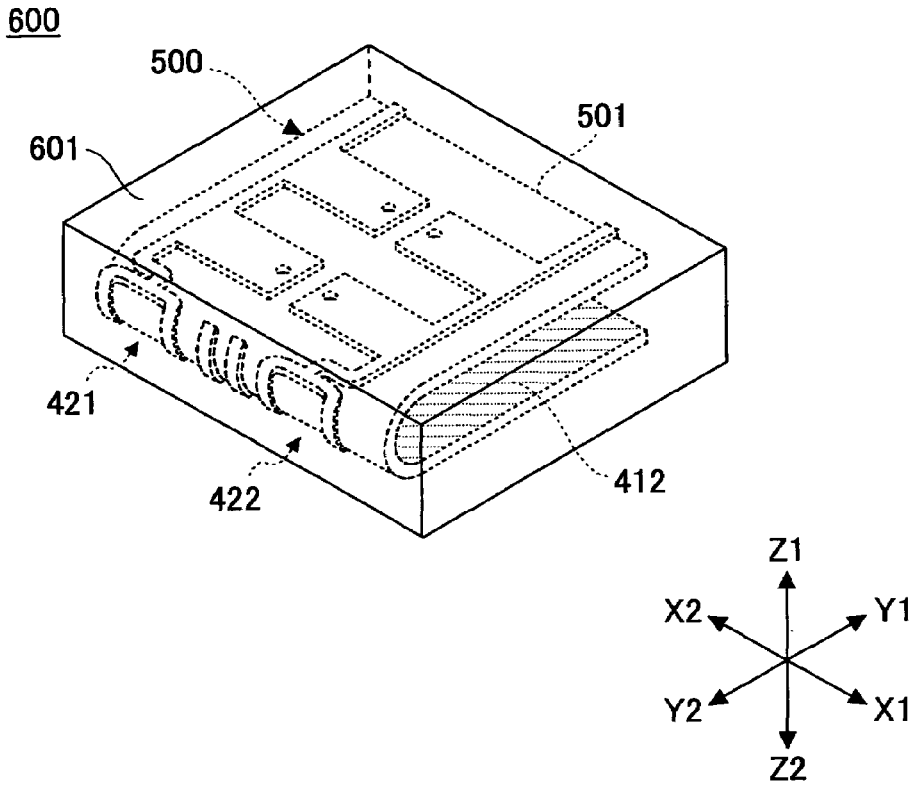
FIG. 24A is a perspective view illustrating a configuration of a filtering device 600 according to a sixth embodiment of the present invention.

FIG. 24A is a perspective view illustrating a configuration of a filtering device 600 according to a sixth embodiment of the present invention.

Figure 24B:
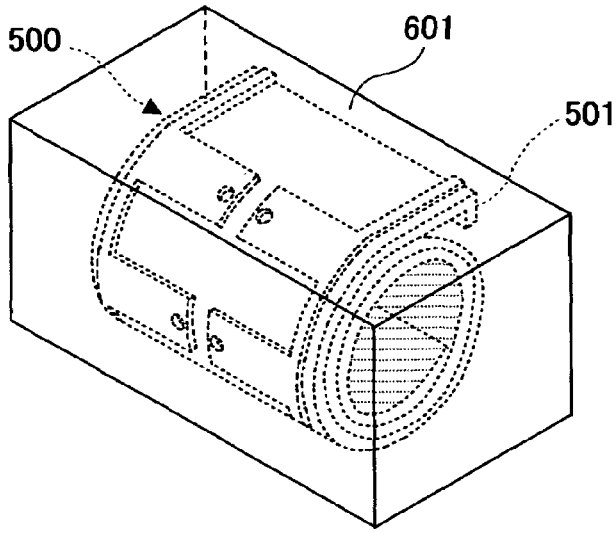
FIG. 24B is a perspective view illustrating a configuration of the filtering device 600 according to the sixth embodiment of the present invention.

FIG. 24B is a perspective view illustrating a configuration of the filtering device 600 according to the present embodiment of the present invention.

In the present embodiment, the same reference numbers are assigned to the same elements as those in FIG. 23A through FIG. 23C, and overlapping descriptions are omitted.

As illustrated in FIG. 24A, the filtering device 600 includes the filtering device 500 and a dielectric resin portion 601, and the filtering device 500 is folded and sealed with the dielectric resin 601. The dielectric resin 601 may be any resin of a high dielectric constant (permittivity) and a high magnetic permeability.

In FIG. 24A, the end portion 501 of the filtering device 500 extends in the Y1 direction. If the end portion 501 is folded downward in the Z2 direction, the end portion 501 is exposed to the outside, and the ports P41 and P61 formed thereon are also exposed to the outside, hence, it is easy to mount the filtering device 600 to other printed circuit boards outside.

In FIG. 24B, in the filtering device 600, the filtering device 500 is rolled and sealed with the dielectric resin 601. By folding the end portion 501 of the filtering device 500 downward in the Z2 direction, the end portion 501 is exposed to the outside, and the ports P41 and P61 formed thereon are also exposed to the outside.

In the present embodiment, because the filtering device 500 is sealed with the dielectric resin 601, due to the wavelength-shortening effect caused by the dielectric constant, the signal wavelength λ in the filtering device 500 is reduced, and widths and lengths of the interconnection patterns, and the rings and stubs of the ring filters can be reduced compared to an un-sealed state; thus, the filtering device 500 can be made more compact.

When using resins of high dielectric constants and high magnetic permeability as the dielectric resin 601, the wavelength-shortening effect is strong, and the filtering device 500 can be made still more compact.

Seventh Embodiment

Figure 25:
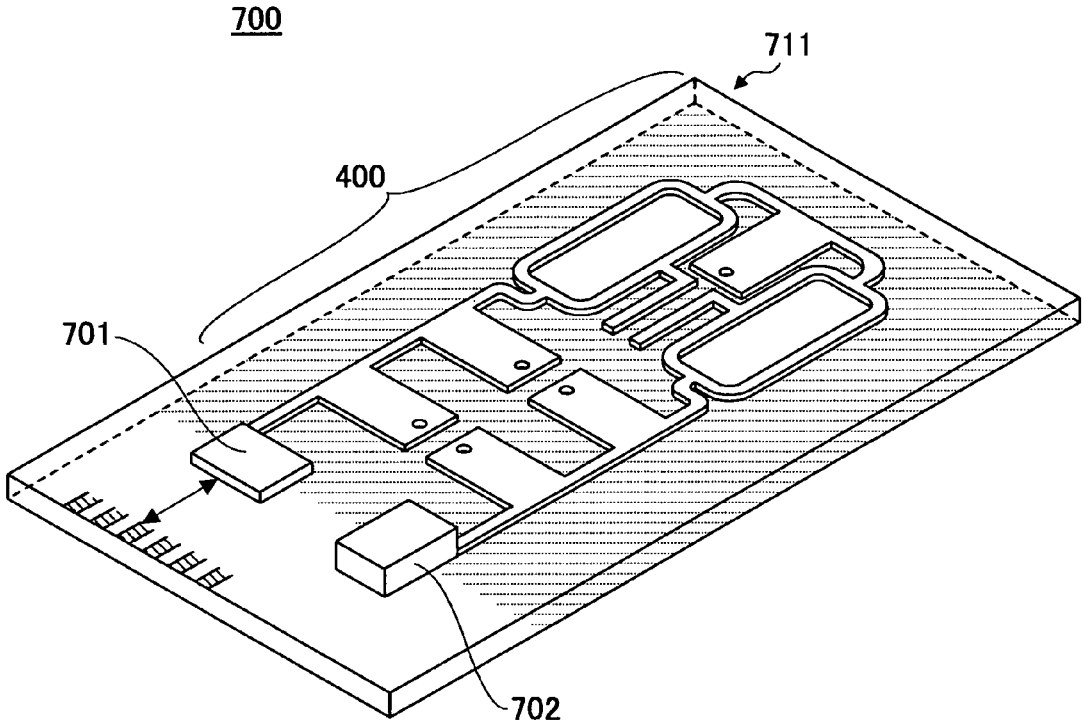
FIG. 25 is a perspective view of a circuit module 700 according to a seventh embodiment of the present invention.

FIG. 25 is a perspective view of a circuit module 700 according to a seventh embodiment of the present invention.

As illustrated in FIG. 25, the circuit module 700 includes the filtering device 400 as shown in FIG. 20, a signal processing IC (integrated circuit) 701, and a chip antenna 702, which are arranged on a printed circuit board 711.

Figure 26:
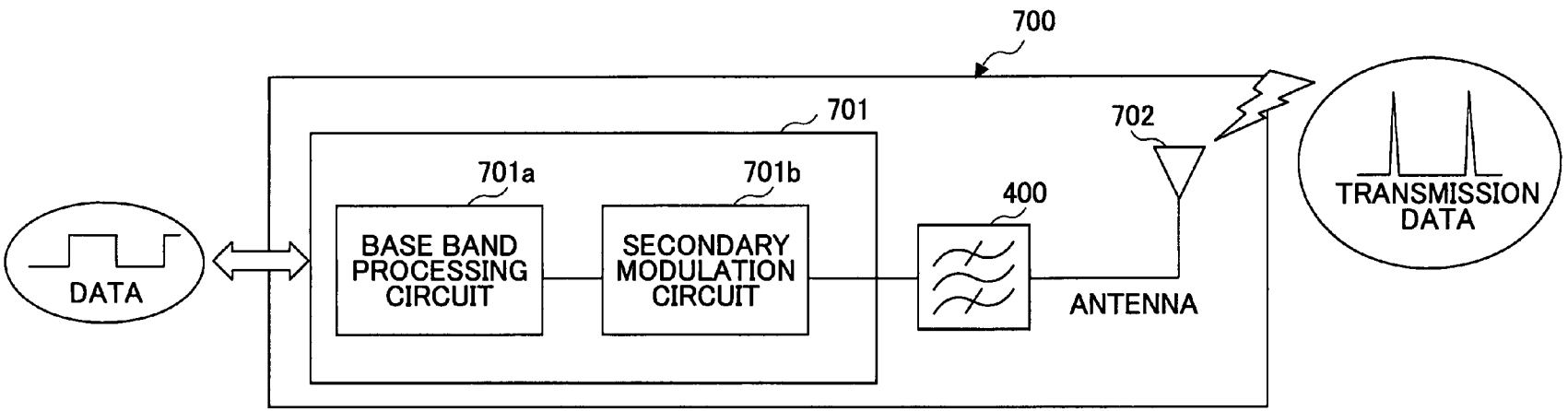
FIG. 26 is a block diagram illustrating a configuration of the circuit module 700 of the seventh embodiment.

FIG. 26 is a block diagram illustrating a configuration of the circuit module 700.

As illustrated in FIG. 26, the signal processing IC 701 includes a base band processing circuit 701*a* and a secondary modulation circuit 701*b*. Signals transmitted from a source outside the printed circuit board 711 are input to the signal processing IC 701. The signal processing IC 701 modulates the input signals, and generates output signals. The signals output from the signal processing IC 701 are input to the filtering device 400, and the filtering device 400 selects signals in a certain pass-band, and transmits the selected signals to the chip antenna 702. The chip antenna 702 transmits the selected signals out of the printed circuit board 711.

In the present embodiment, the filtering device 400 can be included in a unit, that is, the circuit module 700.

In the above, it is described that the signal processing IC 701 mounted on the printed circuit board 711 is used for signal transmission, but the present embodiment is not limited to this situation. For example, a demodulation circuit, or both a demodulation circuit and a modulation circuit may also be mounted on the printed circuit board 711 for signal transmission and signal reception.

In addition, if the printed circuit board 711 is a flexible printed circuit board, and the flexible printed circuit board is folded as illustrated in FIG. 23B, the circuit module 700 can be made compact. Further, if the flexible printed circuit board is folded and is sealed with a dielectric resin, the circuit module 700 can be made more compact.

Eighth Embodiment

Figure 27:
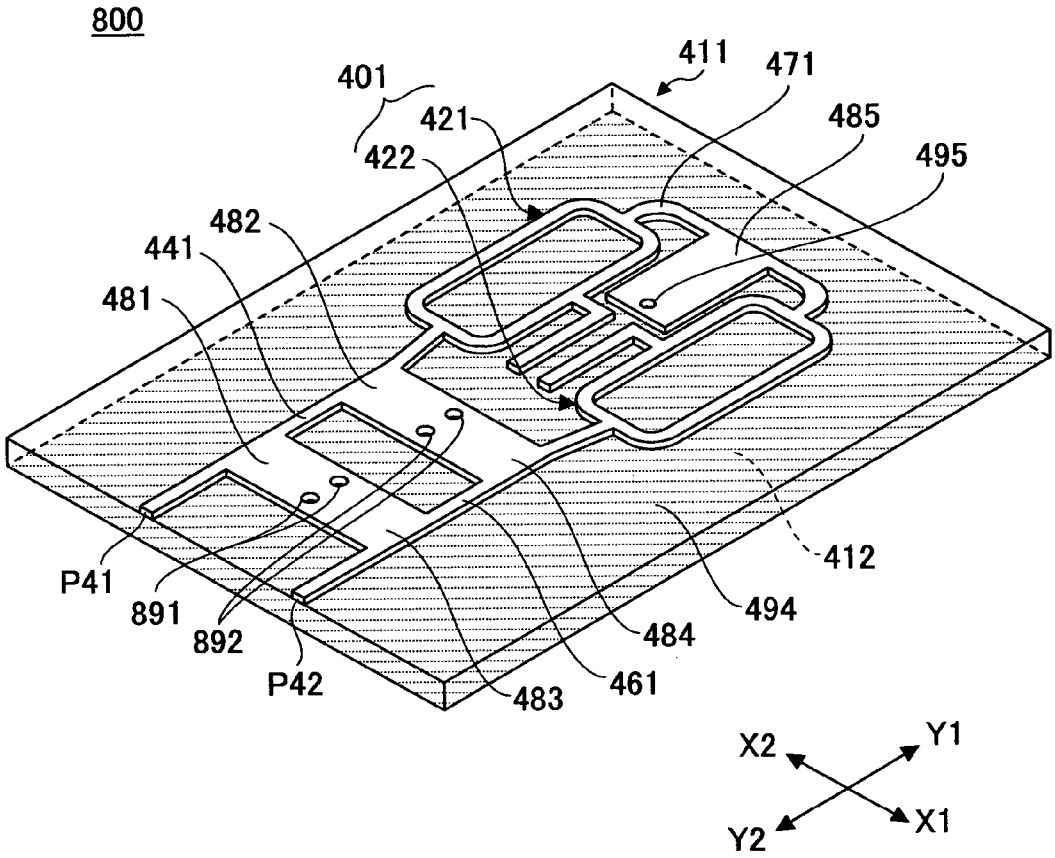
FIG. 27 is a perspective view of a filtering device 800 according to an eighth embodiment of the present invention.

FIG. 27 is a perspective view of a filtering device 800 according to an eighth embodiment of the present invention.

Figure 28:
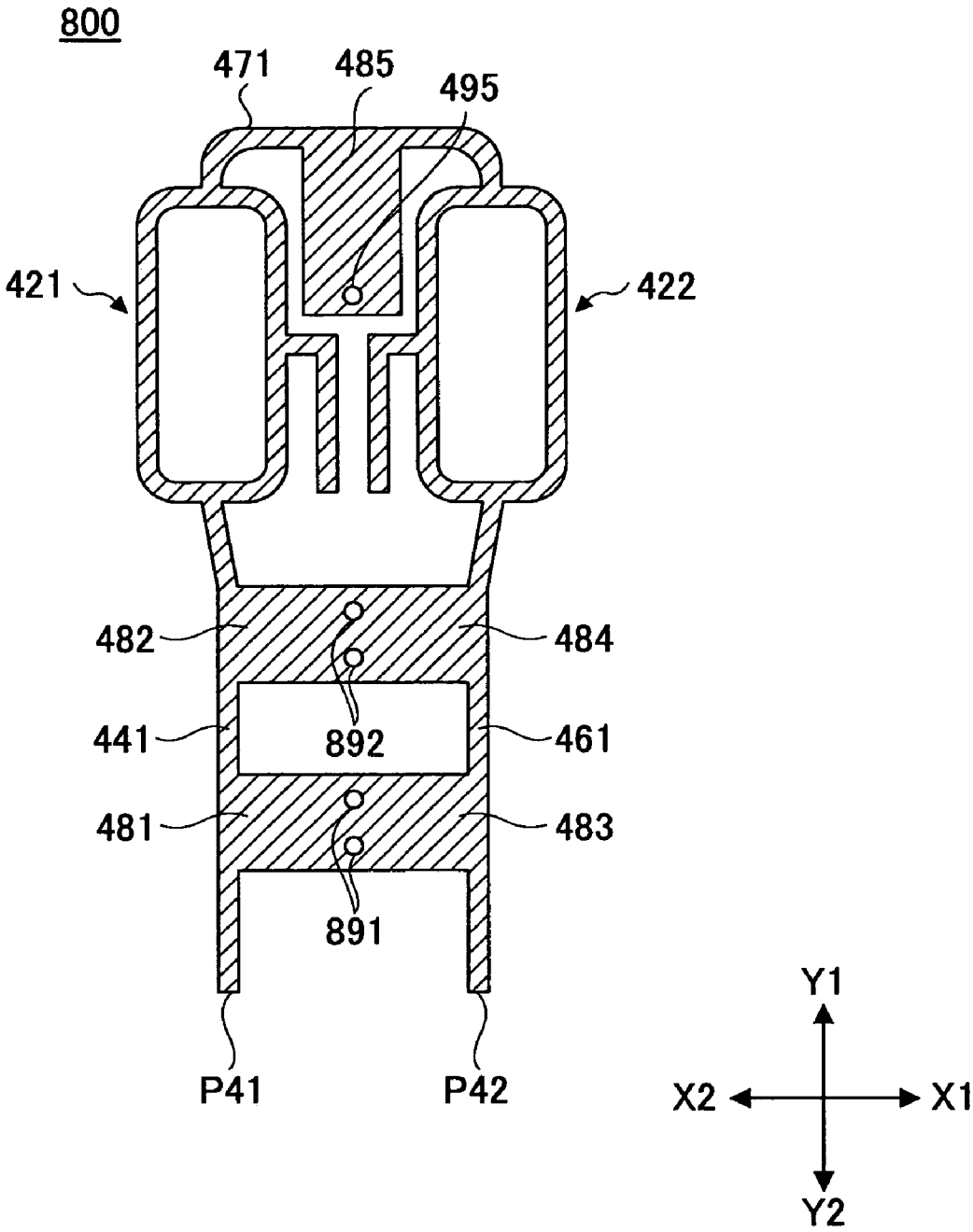
FIG. 28 is a plan view illustrating a configuration of the filtering device 800 of the eighth embodiment.

FIG. 28 is a plan view illustrating a configuration of the filtering device 800.

In the present embodiment, the same reference numbers are assigned to the same elements as those in FIG. 20 and FIG. 21, and overlapping descriptions are omitted.

As illustrated in FIG. 27 and FIG. 28, the filtering device 800 includes a first filtering unit 401 and a second filtering unit 402 arranged on a printed circuit board 411, and the second filtering unit 402 includes five short stubs 481 through 485.

The short stud 481 and the short stud 483 are connected with each other, and through-holes 891 are formed in the connecting portion of the short stud 481 and the short stud 483. The short stud 481 and the short stud 483 are connected to the grounding pattern 412 formed on the entire back side of the printed circuit board 411 through the common through-holes 891.

Similarly, the short stud 482 and the short stud 484 are connected with each other, and through-holes 892 are provided in the connecting portion of the short stud 482 and the short stud 484. The short stud 482 and the short stud 484 are connected to the grounding pattern 412 formed on the entire back side of the printed circuit board 411 through the common through-holes 892.

Ninth Embodiment

Figure 29:
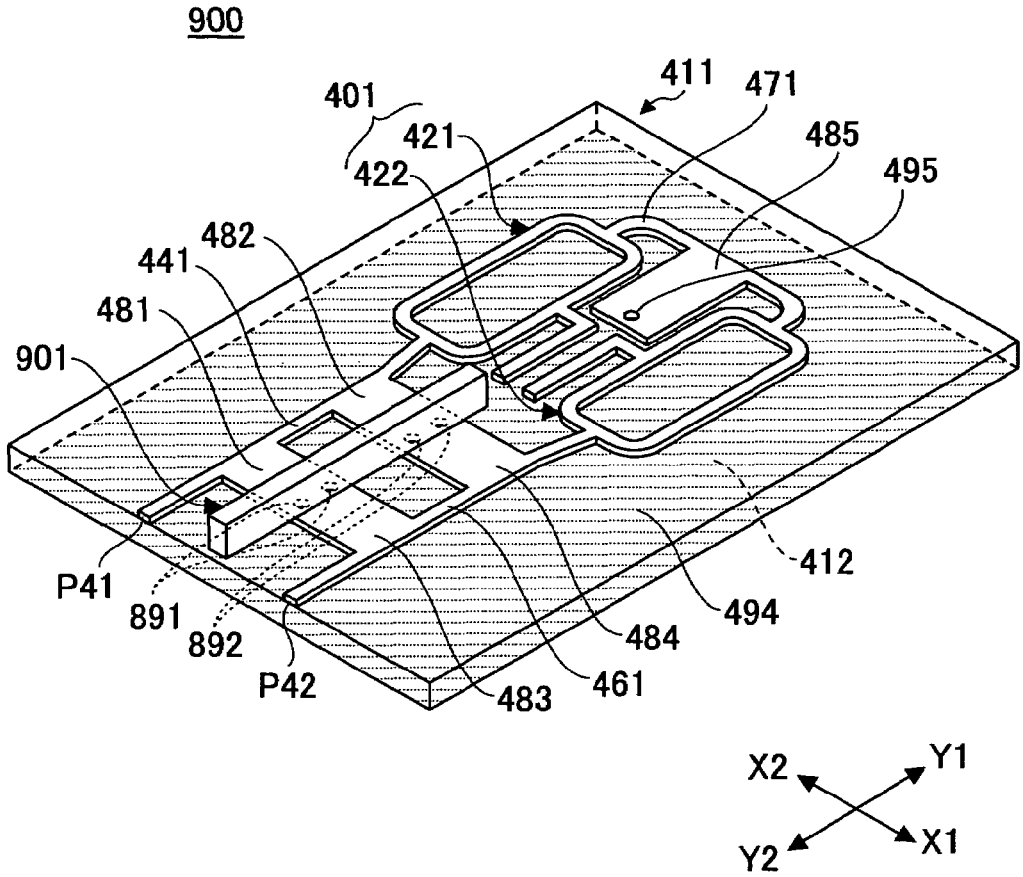
FIG. 29 is a perspective view of a filtering device 900 according to a ninth embodiment of the present invention.

FIG. 29 is a perspective view of a filtering device 900 according to a ninth embodiment of the present invention.

Figure 30:
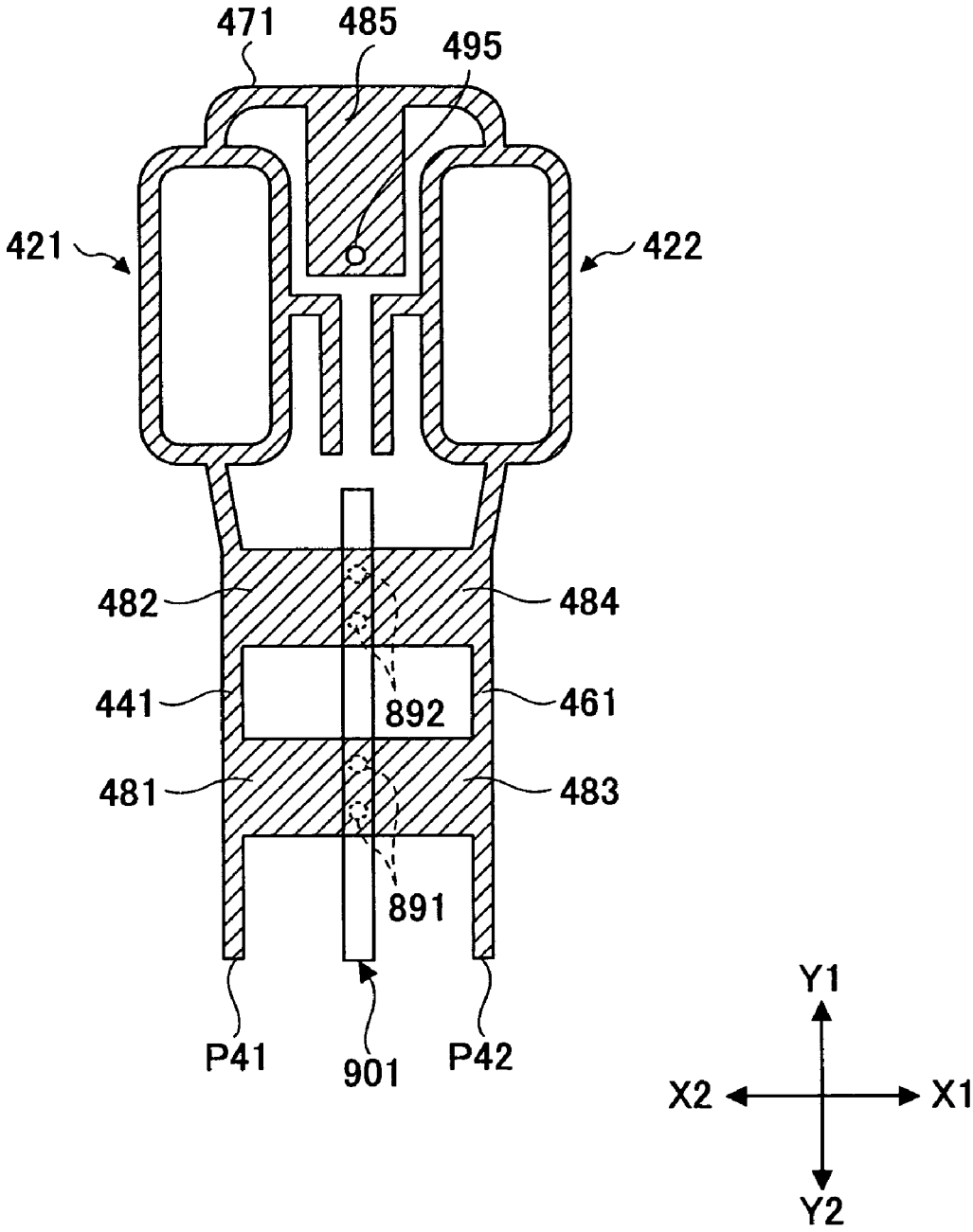
FIG. 30 is a plan view illustrating a configuration of the filtering device 900 of the ninth embodiment.

FIG. 30 is a plan view illustrating a configuration of the filtering device 900.

In the present embodiment, the same reference numbers are assigned to the same elements as those in FIG. 27 and FIG. 28, and overlapping descriptions are omitted.

As illustrated in FIG. 29 and FIG. 30, the filtering device 900 includes a first filtering unit 401 and a second filtering unit 402 arranged on the printed circuit board 411, and the second filtering unit 402 includes five short stubs 481 through 485.

In the filtering device 900, a grounding plate 901 is arranged to stand between the short studs 481 and 482, and the short studs 483 and 484. The grounding plate 901 is inserted into the through-holes 891 and 892 so as to be connected to the grounding pattern 412 on the back side of the printed circuit board 411.

According to the present embodiment, because of the grounding plate 901, interference between the port P41 and the port P42 can be reduced.

10th Embodiment

Figure 31:
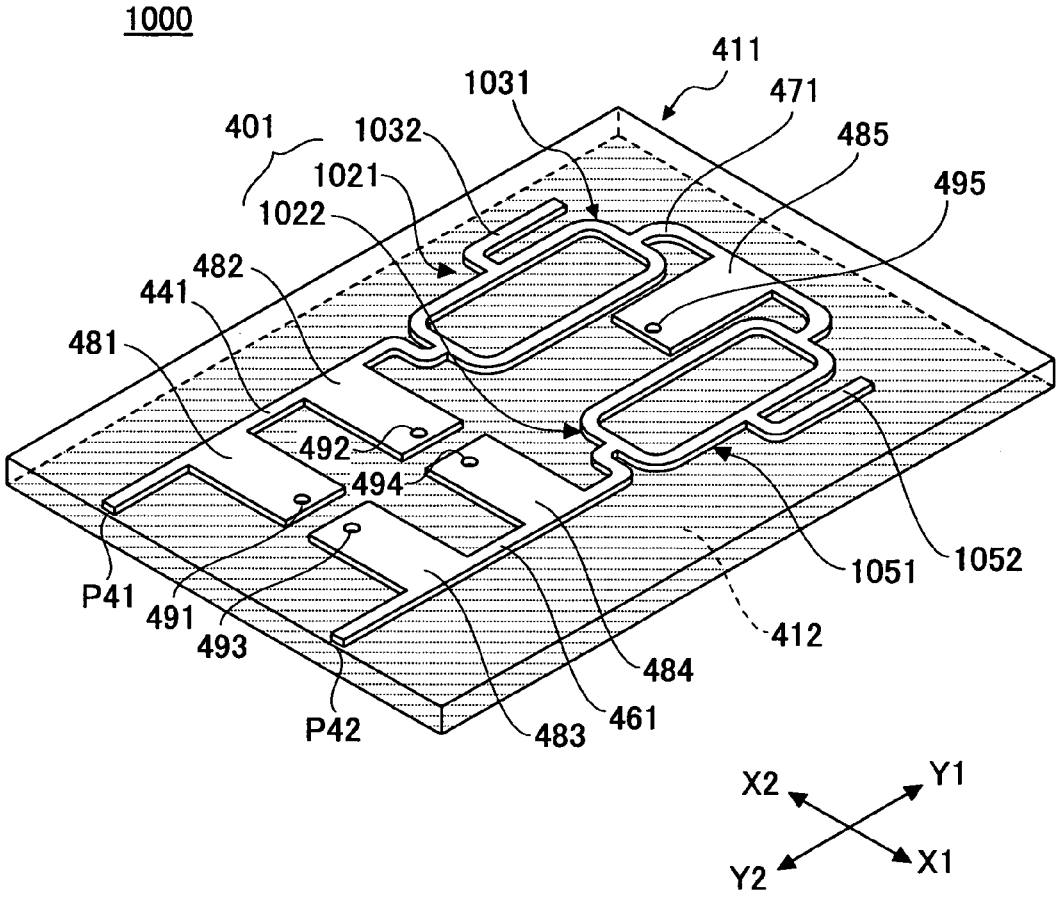
FIG. 31 is a perspective view of a filtering device 1000 according to a 10th embodiment of the present invention.

FIG. 31 is a perspective view of a filtering device 1000 according to a 10th embodiment of the present invention.

Figure 32:
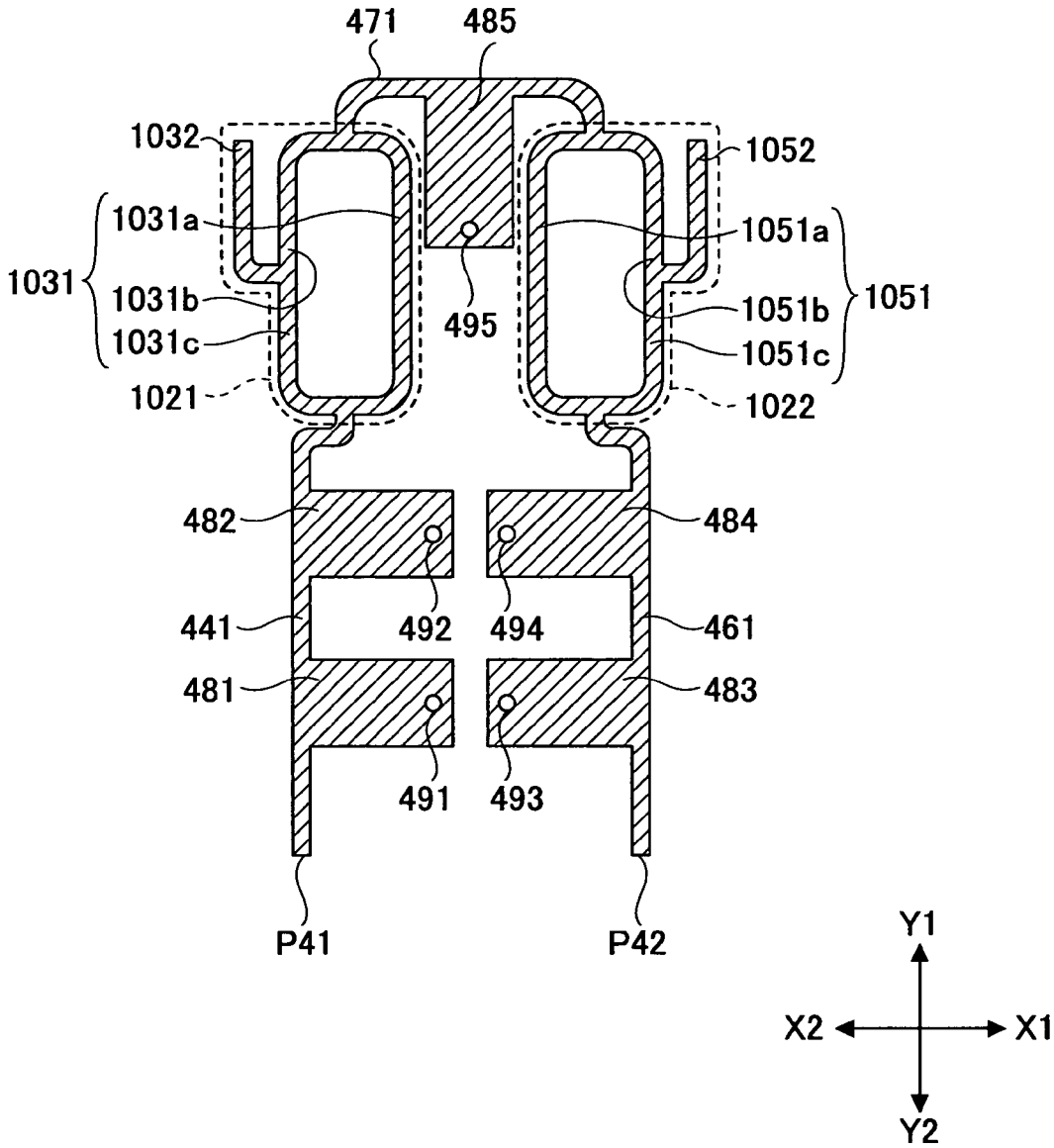
FIG. 32 is a plan view illustrating a configuration of the filtering device 1000 of the 10th embodiment.

FIG. 32 is a plan view illustrating a configuration of the filtering device 1000.

In the present embodiment, the same reference numbers are assigned to the same elements as those in FIG. 20 and FIG. 21, and overlapping descriptions are omitted.

As illustrated in FIG. 31 and FIG. 32, the filtering device 1000 includes a first filtering unit 401 and a second filtering unit 402 arranged on the printed circuit board 411; the first filtering unit 401 includes a first ring filter 1021 and a second ring filter 1022, and the second filtering unit 402 includes five short stubs 481 through 485.

As illustrated in FIG. 31 and FIG. 32, the structures of the first ring filter 1021 and the second ring filter 1022 are different from the ring filters 421 and 422 in FIG. 20 and FIG. 21.

The first ring filter 1021 includes a ring portion 1031 and an open stub 1032. The ring portion 1031 includes a λ/2 path portion 1031*a*, a first λ/4 path portion 1031*b*, and a second λ/4 path portion 1031*c*. The first ring filter 1021 has nearly an elliptic shape, with a long side along the Y1-Y2 direction, and a short side along the X1-X2 direction. In addition, the λ/2 path portion 1031*a* is on the X1 side of the ring portion 1031, and the first λ/4 path portion 1031*b* and the second λ/4 path portion 1031*c* are on the X2 side of the ring portion 1031.

The length of the open stub 1032 is set to be approximately λ/4. The open stub 1032 has a folded shape, including a first portion extending in the X2 direction from the connecting point of the first λ/4 path portion 1031*b* and the second λ/4 path portion 1031*c*, and a second portion extending in the Y1 direction.

The first ring filter 1021 is connected to the port P41 through the first interconnection pattern 441 which extends in the Y2 direction.

The second ring filter 1022 includes a ring portion 1051 and an open stub 1052. The ring portion 1051 includes a λ/2 path portion 1051*a*, a first λ/4 path portion 1051*b*, and a second λ/4 path portion 1051*c*. The first ring filter 1051 has nearly an elliptic shape, with a long side along the Y1-Y2 direction, and a short side along the X1-X2 direction. In addition, the λ/2 path portion 1051*a* is on the X2 side of the ring portion 1051, and the first λ/4 path portion 1051*b* and the second λ/4 path portion 1051*c* are on the X1 side of the ring portion 1051.

The length of the open stub 1052 is set to be approximately λ/4. The open stub 1032 has a folded shape, including a first portion extending in the X1 direction from the connecting point of the first λ/4 path portion 1051*b* and the second λ/4 path portion 1051*c*, and a second portion extending in the Y1 direction.

The second ring filter 1022 is connected to the port P41 through the first interconnection pattern 441 which extends in the Y2 direction.

11th Embodiment

In the previous embodiments, filtering devices including two stages of ring filters and three stages of short stubs are described. In the present embodiment, a filtering device including three stages of ring filters and two stages of short stubs is described.

Figure 33:
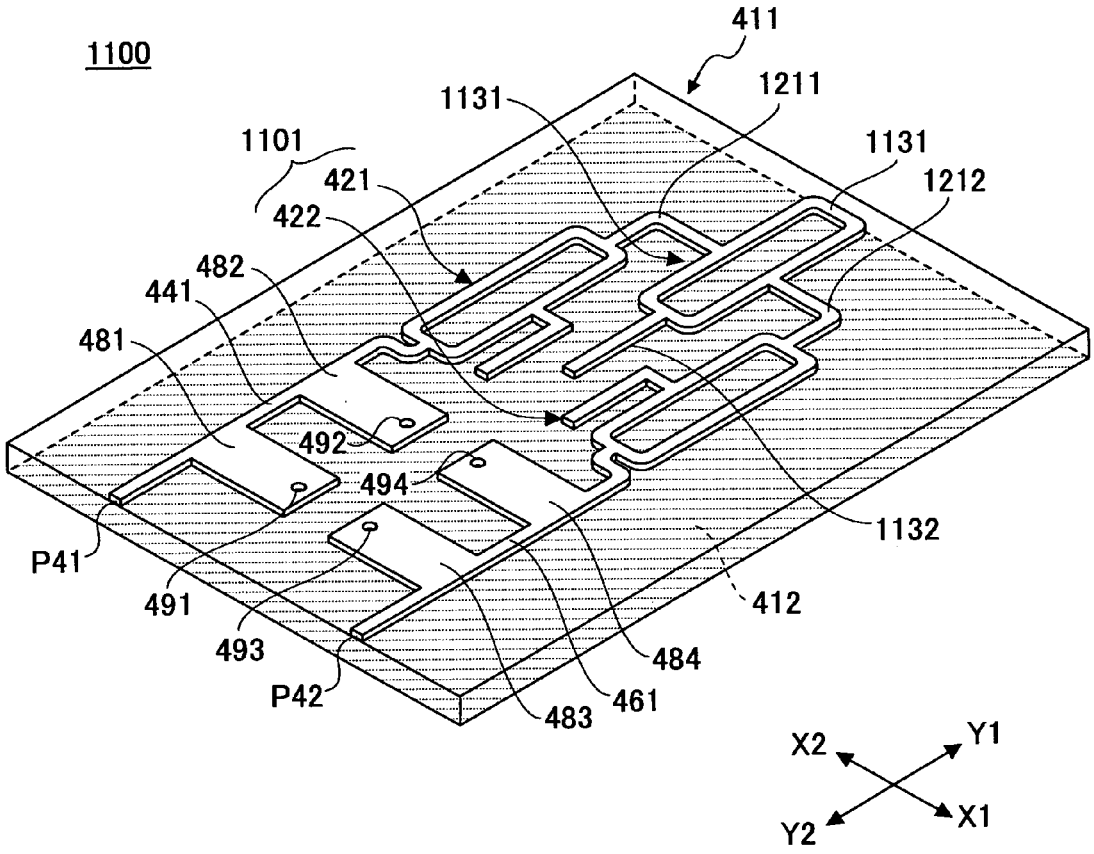
FIG. 33 is a perspective view of a filtering device 1100 according to an 11th embodiment of the present invention.

FIG. 33 is a perspective view of a filtering device 1100 according to an 11th embodiment of the present invention.

Figure 34:
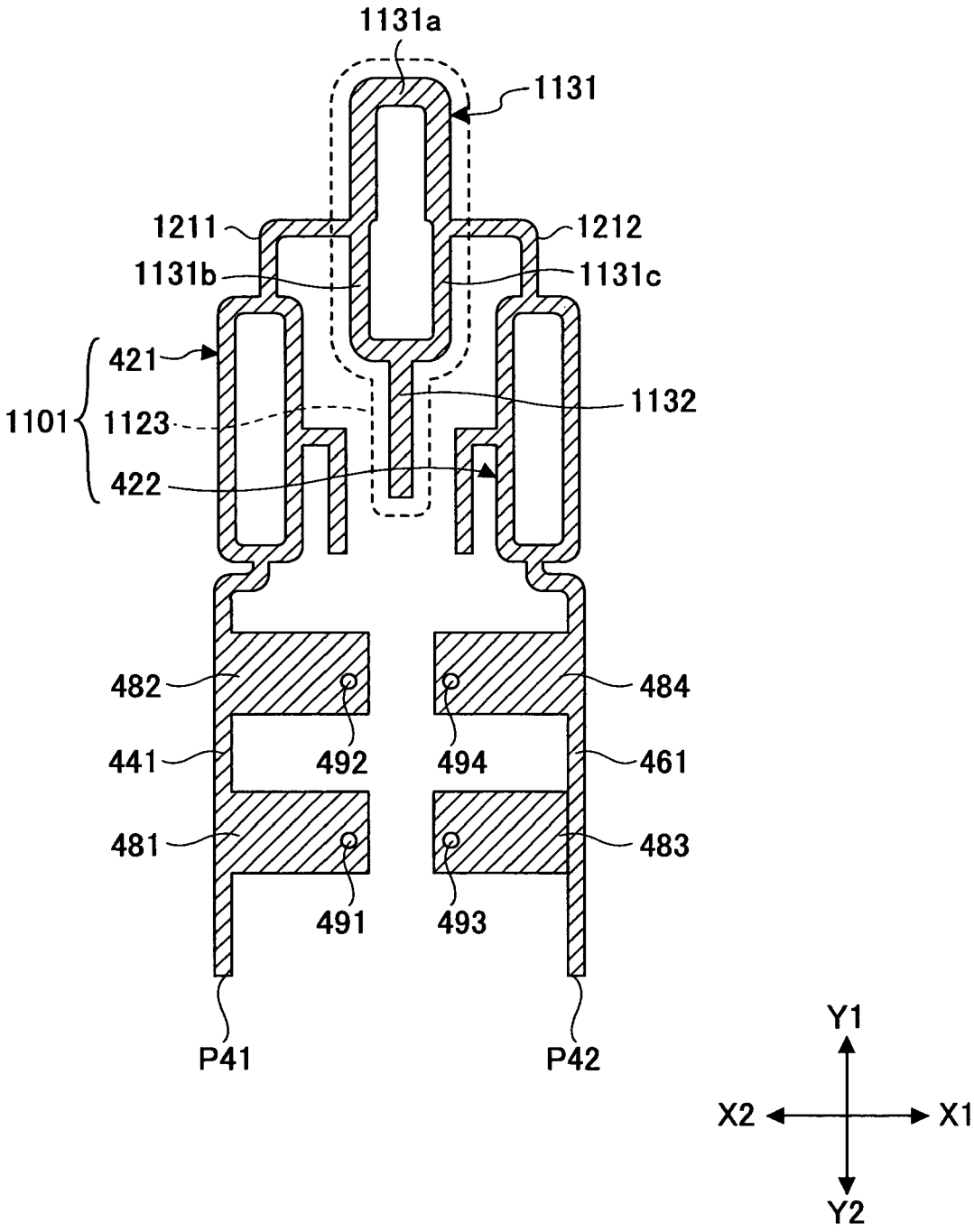
FIG. 34 is a plan view illustrating a configuration of the filtering device 1100 of the 11th embodiment.

FIG. 34 is a plan view illustrating a configuration of the filtering device 1100.

In the present embodiment, the same reference numbers are assigned to the same elements as those in FIG. 20 and FIG. 21, and overlapping descriptions are omitted.

As illustrated in FIG. 33 and FIG. 34, the filtering device 1100 includes a first filtering unit 1101 and a second filtering unit 1102, which are conductive patterns arranged on the printed circuit board 411.

The first filtering unit 1101 includes a first ring filter 421, a second ring filter 422, and a third ring filter 1123, each of which has a stub.

The third ring filter 1123 includes a ring portion 1131 and an open stub 1132. The ring portion 1131 includes a λ/2 path portion 1131*a*, a first λ/4 path portion 1131*b*, and a second λ/4 path portion 1131*c*. The third ring filter 1123 has nearly an elliptic shape, with a long side along the Y1-Y2 direction, and a short side along the X1-X2 direction. Because of such a shape, the width spread in the X1-X2 direction is reduced.

The length of the open stub 1132 is set to be approximately λ/4. The open stub 1132 extends in the Y2 direction from the connecting point of the first λ/4 path portion 1131*b* and the second λ/4 path portion 1131*c*.

The third ring filter 1123 is connected to the first ring filter 421 through an interconnection pattern 1211 which first extends in the X2 direction and is then folded from the X2 direction to the Y2 direction and is connected to the first ring filter 421.

The third ring filter 1123 is connected to the second ring filter 423 through an interconnection pattern 1212 which first extends in the X1 direction and is then folded from the X1 direction to the Y2 direction and is connected to the second ring filter 422.

The second filtering unit 1102 is for attenuating components of frequencies lower than the low attenuation pole frequency in the band-elimination characteristics of the first filtering unit 1101. The second filtering unit 1102 includes four short stubs 481 through 484, without the short stub 485 shown in FIG. 20.

Figure 35:
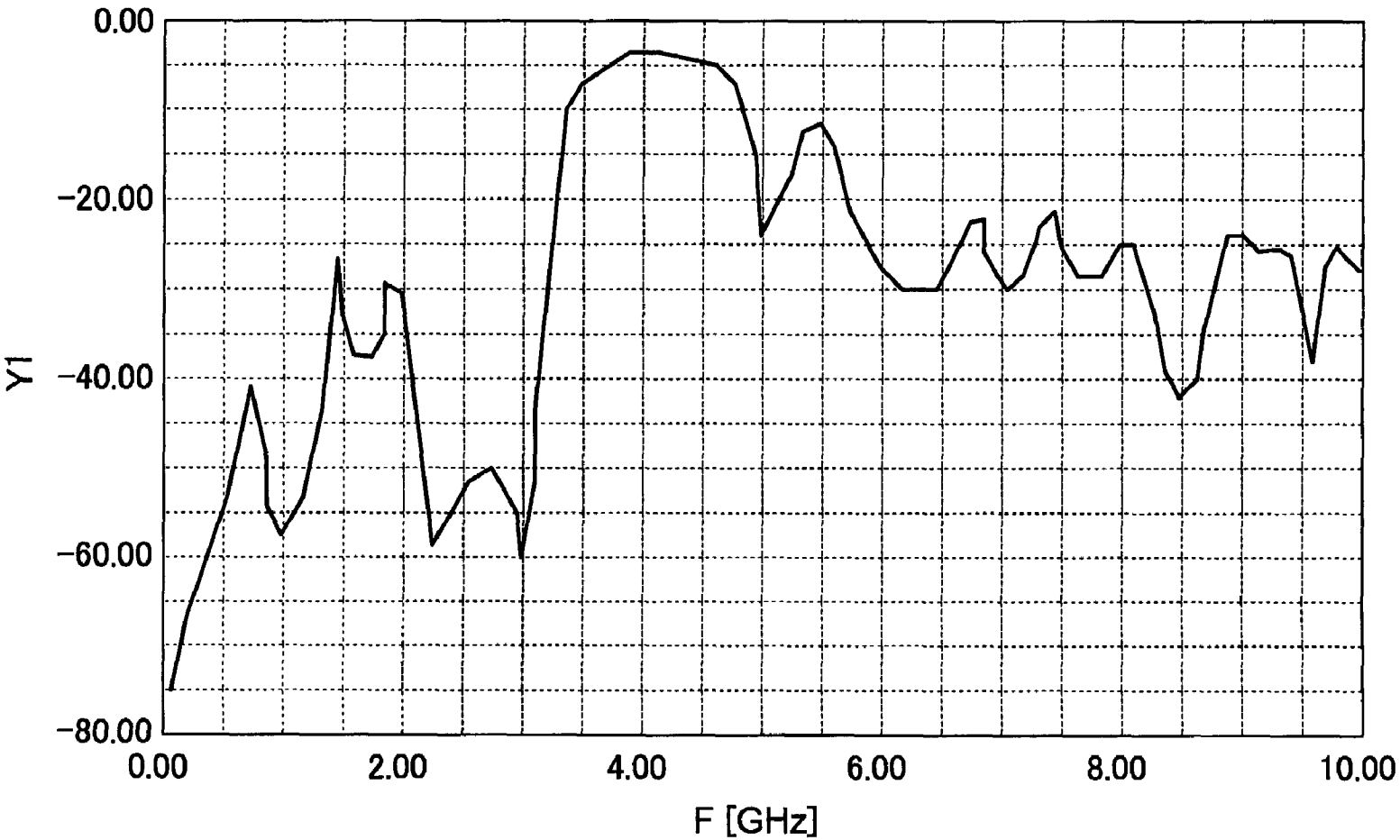
FIG. 35 shows the band characteristics of the filtering device 1100 of the 11th embodiment.

FIG. 35 shows the band characteristics of the filtering device 1100.

According to the filtering device 1100 of the present embodiment, it is possible to obtain band-pass characteristics as shown in FIG. 35. With the stage number of the ring filters being increased by one, the stop-band becomes broad, and it is possible to reduce influence on the band-pass characteristics of the short stub near the attenuation pole, and it is possible to make use of the sharp attenuation characteristics of the ring filter near the attenuation pole.

It is apparent that the filtering devices of the fifth to 10th embodiments, and the modification to the fourth embodiment, can also be applied to the filtering device 1100 of the present embodiment.

While the invention is described above with reference to specific embodiments chosen for purpose of illustration, it should be apparent that the invention is not limited to these embodiments, but numerous modifications could be made thereto by those skilled in the art without departing from the basic concept and scope of the invention.

This patent application is based on Japanese Priority Patent Application No. 2004-136268 filed on Apr. 30, 2004, the entire contents of which are hereby incorporated by reference.

What is claimed is:

1. A filtering device for passing predetermined frequency components of an input signal, comprising;

a first filtering unit, including a distributed constant circuit, eliminating a first frequency component having a first frequency and a second frequency component having a second frequency, said first frequency and said second frequency being symmetrically located on two opposite sides of a center frequency and said second frequency being higher than said first frequency; and a second filtering unit that attenuates components of frequencies lower than the first frequency and components of frequencies higher than the second frequency.

2. The filtering device as claimed in claim 1, wherein the first filtering unit includes a ring filter having a stub.

3. The filtering device as claimed in claim 2, wherein the first filtering unit includes a plurality of the ring filters connected in cascade.

4. The filtering device as claimed in claim 1, wherein the second filtering unit includes:

a high-pass filter formed from a lumped constant circuit and configured to attenuate the components of frequencies lower than the first frequency; and a low-pass filter formed from a lumped constant circuit and configured to attenuate components of frequencies higher than the second frequency.

5. The filtering device as claimed in claim 1, wherein the second filtering unit includes a distributed constant circuit.

6. The filtering device as claimed in claim 5, wherein the distributed constant circuit includes a short stub.

7. The filtering device as claimed in claim 6, wherein the second filtering unit includes plural stages of short stubs.

8. The filtering device as claimed in claim 5, wherein:

the first filtering unit includes a first ring filter having a first open stub, and a second ring filter having a second open stub, an input port of said second ring filter being connected to an output port of the first ring filter;

the second filtering unit includes a first short stub section, a second short stub section, and a third short stub section;

each of said first short stub section, said second short stub section, and said third short stub section includes at least one short stub;

the first short stub section is formed on a first interconnection pattern connected to an input port of the first ring filter;

the second shod stub section is formed on a second interconnection pattern connected to an output port of the second ring filter; and the third short stub section is formed on a third interconnection pattern for connecting an output port of the first ring filter and an input port of the second ring filter.

9. The filtering device as claimed in claim 8, wherein portions of the third interconnection pattern respectively connecting to the first ring filter and the second ring filter are folded.

10. The filtering device as claimed in claim 9, wherein:

the first open stub extends toward the second ring filter; and the second open stub extends toward the first ring filter.

11. The filtering device as claimed in claim 9, wherein:

the first short stub section extends from the first interconnection pattern toward the second interconnection pattern; and the second short stub section extends from the second interconnection pattern toward the first interconnection pattern.

12. The filtering device as claimed in claim 9, wherein an end of the first short stub section and an end of the second short stub section are connected to a common grounding part.

13. The filtering device as claimed in claim 12, wherein the grounding part includes a conductive plate that is grounded and is arranged between the first short stub section and the second short stub section.

14. The filtering device as claimed in claim 8, wherein corners of at least one of the first open stub and the second open stub are rounded.

15. The filtering device as claimed in claim 5, wherein:

the first filtering unit includes a first ring filter having a first open stub, a second ring filter having a second open stub, and a third ring filter having a third open stub, an input port of said third ring filter being connected to an output port of the first ring filter, and an output port of said third ring filter being connected to an input port of the second ring filter;

the second filtering unit includes a first short stub section and a second short stub section;

each of said first short stub section and said second short stub section includes at least one short stub;

the first short stub section is formed on a first interconnection pattern connected to an input port of the first ring filter; and the second short stub section is formed on a second interconnection pattern connected to an output port of the second ring filter.

16. The filtering device as claimed in claim 15, wherein the first ring filter, the second ring filter, and the third ring filter are arranged such that the first ring filter, the second ring filter, and the third ring filter form a folded shape with the first ring filter and the second ring filter on two sides of the third ring filter.

17. The filtering device as claimed in claim 16, wherein each of the first open stub, the second open stub, and the third open stub include a portion extending toward outside of the folded shape.

18. The filtering device as claimed in claim 16, wherein each of the first open stub and the second open stub includes a portion extending toward inside of the folded shape.

19. The filtering device as claimed in claim 1, wherein the first filtering unit and the second filtering unit are arranged on the same circuit board.

20. The filtering device as claimed in claim 19, wherein chip parts constituting peripheral circuits of the first filtering unit and the second filtering unit are arranged on the circuit board.

21. The filtering device as claimed in claim 19, wherein the circuit board is a flexible circuit board, and the flexible circuit board is folded.

22. The filtering device as claimed in claim 19, wherein the circuit board is a flexible circuit board, and the flexible circuit board is rolled.

23. The filtering device as claimed in claim 1, wherein the first filtering unit and the second filtering unit are sealed with a dielectric sealing agent.

24. A filtering device passing predetermined frequency components of an input signal, comprising:

a first filtering unit, including a distributed constant circuit, eliminating a first frequency component having a first frequency or a second frequency component having a second frequency, said second frequency being higher than said first frequency; and a second filtering unit attenuating at least one of components of frequencies lower than the first frequency and components of frequencies higher than the second frequency;

wherein the second filtering unit includes:

a high-pass filter formed from a lumped constant circuit and attenuating the components of frequencies lower than the first frequency; and a low-pass filter formed from a lumped constant circuit and attenuating components of frequencies higher than the second frequency.

25. A filtering device for passing predetermined frequency components of an input signal, comprising:

a first filtering unit, including a distributed constant circuit, eliminating a first frequency component having a first frequency and a second frequency component having a second frequency, said first frequency and said second frequency being symmetrically located on two sides of a center frequency and said second frequency being higher than said first frequency; and a second filtering unit, including a short stub, attenuating components of frequencies lower than the first frequency or components of frequencies higher than the second frequency.

26. A filtering device for passing predetermined frequency components of an input signal, comprising:

a first filtering unit, including a distributed constant circuit, eliminating a first frequency component having a first frequency and a second frequency component having a second frequency, said first frequency and said second frequency being symmetrically located on two sides of a center frequency and said second frequency being higher than said first frequency; and a second filtering unit that includes a short stub and attenuates components of frequencies lower than the first frequency or components of frequencies higher than the second frequency, wherein:

the first filtering unit and the second filtering unit are arranged on a flexible printed circuit board; and the flexible printed circuit board is folded.

27. A filtering device for passing predetermined frequency components of an input signal, comprising:

a first filtering unit, including a distributed constant circuit, eliminating a first frequency component having a first frequency and a second frequency component having a second frequency, said first frequency and said second frequency being symmetrically located on two sides of a center frequency and said second frequency being higher than said first frequency; and a second filtering unit that includes a short stub and attenuates components of frequencies lower than the first frequency or components of frequencies higher than the second frequency;

wherein:

the first filtering unit and the second filtering unit are arranged on a flexible printed circuit board; and the flexible printed circuit board is rolled.

28. A circuit module, comprising:

a circuit board;

a first filtering unit, formed from conductive patterns on the circuit board and functioning as a distributed constant circuit eliminating a first frequency component having a first frequency and a second frequency component having a second frequency, said first frequency and said second frequency being symmetrically located on two sides of a center frequency and said second frequency being higher than said first frequency, chip parts arranged on the circuit board and constituting peripheral circuits of the filtering unit;

a second filtering unit that includes a short stub and attenuates components of frequencies lower than the first frequency or components of frequencies higher than the second frequency; wherein:

the first filtering unit and the second filtering unit are arranged on a flexible printed circuit board; and the flexible printed circuit board is rolled.

29. A circuit module, comprising:

a first filtering unit including a distributed constant circuit having a plurality of stubs, corners of the stubs in proximity of other stubs being rounded, and eliminating a first frequency component having a first frequency and a second frequency component having a second frequency, said first frequency and said second frequency being symmetrically located on two sides of a center frequency and said second frequency being higher than said first frequency;

a second filtering unit that includes a short stub and attenuates components of frequencies lower than the first frequency or components of frequencies higher than the second frequency;

the first filtering unit and the second filtering unit being arranged on a flexible printed circuit board; and the flexible printed circuit board being rolled.

30. A circuit module, comprising:

a flexible printed circuit board on which a distributed constant circuit is arranged, the flexible printed circuit board being sealed by using a dielectric resin with the flexible printed circuit board being folded or rolled;

a first filtering unit, including the distributed constant circuit, eliminating a first frequency component having a first frequency and a second frequency component having a second frequency symmetrically located on two sides of a center frequency and said second frequency being higher than said first frequency; and a second filtering unit, that including a shod stub, attenuating components of frequencies lower than the first frequency or components of frequencies higher than the second frequency, wherein:

the first filtering unit and the second filtering unit are arranged on the flexible printed circuit board.

* * * * *

UNITED STATES PATENT AND TRADEMARK OFFICE

CERTIFICATE OF CORRECTION

PATENT NO. : 7,528,687 B2
APPLICATION NO. : 11/106639
DATED : May 5, 2009
INVENTOR(S) : Hiroto Inoue et al.

It is certified that error appears in the above-identified patent and that said Letters Patent is hereby corrected as shown below:

Column 16, Line 20, change “comprising;” to --comprising:--.

Column 16, Line 65, change “shod” to --short--.

Column 17, Lines 4-7, change
“9. The filtering device as claimed in claim 8, wherein portions of the third interconnection pattern respectively connecting to the first ring filter and the second ring filter are folded.” To
-- 9. The filtering device as claimed in claim 8, wherein portions of the third interconnection pattern respectively connecting to the first ring filter and the second ring filter are folded. --.

Column 20, Lines 14-18, change
“a flexible printed circuit board on which a distributed constant circuit is arranged, the flexible printed circuit board being sealed by using a dielectric resin with the flexible printed circuit board being folded or rolled;” to
-- a flexible printed circuit board on which a distributed constant circuit is arranged, the flexible printed circuit board being sealed by using a dielectric resin with the flexible printed circuit board being folded or rolled; --.

UNITED STATES PATENT AND TRADEMARK OFFICE

CERTIFICATE OF CORRECTION

PATENT NO. : 7,528,687 B2
APPLICATION NO. : 11/106639
DATED : May 5, 2009
INVENTOR(S) : Hiroto Inoue et al.

It is certified that error appears in the above-identified patent and that said Letters Patent is hereby corrected as shown below:

Column 20, Line 25, change "shod" to --short--.

Signed and Sealed this

Fifteenth Day of September, 2009

David J. Kappos

David J. Kappos
*Director of the United States Patent and Trademark Office*